US010400588B2

(12) United States Patent
Douglas

(10) Patent No.: US 10,400,588 B2
(45) Date of Patent: Sep. 3, 2019

(54) RECIPROCATING ROTARY VALVE ACTUATOR SYSTEM

(71) Applicant: Halliburton Energy Services, Inc., Houston, TX (US)

(72) Inventor: Hugh Douglas, Atascocita, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/736,462

(22) PCT Filed: Jul. 7, 2016

(86) PCT No.: PCT/US2016/041314

§ 371 (c)(1),
(2) Date: Dec. 14, 2017

(87) PCT Pub. No.: WO2018/009195

PCT Pub. Date: Jan. 11, 2018

(65) Prior Publication Data

US 2019/0112920 A1 Apr. 18, 2019

(51) Int. Cl.
*E21B 47/18* (2012.01)
*E21B 34/06* (2006.01)

(52) U.S. Cl.
CPC ..... *E21B 47/18* (2013.01); *E21B 34/06* (2013.01); *E21B 47/182* (2013.01)

(58) Field of Classification Search
CPC ..... E21B 47/18; E21B 34/06; E21B 47/182
See application file for complete search history.

(56) References Cited

U.S. PATENT DOCUMENTS 4,596,970 A 6/1986 Vanderlaan et al.
4,785,300 A 11/1988 Chin et al.
(Continued)

FOREIGN PATENT DOCUMENTS

WO WO 2014/071514 A1 5/2014
WO WO 2014/071519 A1 5/2014
(Continued)

OTHER PUBLICATIONS

International Search Report and The Written Opinion of the International Search Authority, or the Declaration, dated Mar. 14, 2017, PCT/US2016/041314, 10 pages, ISA/KR.
(Continued)

*Primary Examiner* — Nay Tun
(74) *Attorney, Agent, or Firm* — Haynes and Boone, LLP

(57) ABSTRACT

A system and method to for communicating with a telemetry tool by generating mud pressure waveforms is disclosed according to one or more embodiments. The system includes a rotor having a first bore spaced axially apart from a second bore and a blade disposed therebetween, a stator having a first and second component with a portion of each stator component disposed in a respective one of the first and second rotor bores, and an actuator having a tubular core wrapped with a winding and a plurality of magnets. The rotor blade includes a plurality of cutouts that may be aligned with a plurality of through bores disposed on each stator component when the rotor is in an open position. The core, winding, magnets, and rotor operate like a limited angle torque motor to electromagnetically produce torque by reciprocatingly rotating the rotor within an angle of rotation.

20 Claims, 18 Drawing Sheets

(56) References Cited

U.S. PATENT DOCUMENTS

| | | | | |
|---|---|---|---|---|
| 4,822,569 | A | 4/1989 | Pellegrino | |
| 5,734,209 | A * | 3/1998 | Hallidy | E21B 43/128 310/12.04 |
| 5,787,052 | A | 7/1998 | Gardner et al. | |
| 6,636,159 | B1 | 10/2003 | Winnacker | |
| RE40,944 | E | 10/2009 | Seyler et al. | |
| 8,251,160 | B2 | 8/2012 | Gopalan et al. | |
| 8,514,657 | B2 | 8/2013 | Sitka | |
| 8,694,870 | B2 | 4/2014 | Li | |
| 9,000,939 | B2 | 4/2015 | Sitka et al. | |
| 2002/0121377 | A1 * | 9/2002 | Longbottom | E21B 41/0085 166/372 |
| 2005/0117453 | A1 | 6/2005 | Lehr | |
| 2006/0022840 | A1 * | 2/2006 | Spring | E21B 17/003 340/854.3 |
| 2008/0055110 | A1 | 3/2008 | Hahn et al. | |
| 2008/0068929 | A1 | 3/2008 | Hahn et al. | |
| 2010/0157735 | A1 | 6/2010 | Allan et al. | |
| 2010/0230113 | A1 | 9/2010 | Hutin et al. | |
| 2012/0275942 | A1 * | 11/2012 | Knapp | H02K 1/165 417/423.3 |
| 2014/0007660 | A1 | 1/2014 | Moeller et al. | |
| 2015/0034294 | A1 * | 2/2015 | Miles | E21B 47/122 166/66.5 |
| 2015/0267504 | A1 * | 9/2015 | Hannegan | E21B 19/002 166/340 |
| 2017/0234073 | A1 * | 8/2017 | Nguyen | E21B 7/24 175/40 |

FOREIGN PATENT DOCUMENTS

| | | | |
|---|---|---|---|
| WO | WO 2014/094150 | A1 | 6/2014 |
| WO | WO 2014/094160 | A1 | 6/2014 |
| WO | WO 2014/131125 | A1 | 9/2014 |
| WO | WO 2015/065452 | A1 | 5/2015 |

OTHER PUBLICATIONS

Wasserman et al., "Mud-Pulse Telemetry Sees Step-Change Improvement With Oscillating Shear Valves," Oil and Gas Journal, vol. No. 106, Issue No. 24, Jun. 23, 2008, pp. 39-47.

Zhidan et al., "Design of a Rotary Valve Orifice for a Continuous Wave Mud Pulse Generator," Precision Engineering, vol. 41, Jul. 2015, pp. 111-118.

* cited by examiner

RECIPROCATING ROTARY VALVE ACTUATOR SYSTEM

PRIORITY

The present application is a U.S. National Stage patent application of International Patent Application No. PCT/US2016/041314, filed on Jul. 7, 2016, the benefit of which is claimed and the disclosure of which is incorporated herein by reference in its entirety.

TECHNICAL FIELD

The present disclosure generally relates to a telemetry system for transmitting data from a downhole drilling assembly to the surface of a well during drilling operations. More particularly, the present disclosure relates to a telemetry system having a reciprocating rotary valve actuator system.

BACKGROUND

Wellbores are often drilled through a geologic formation for hydrocarbon exploration and recovery operations. Drilling and production operations involve a great quantity of information and measurements relating to parameters and conditions downhole. Such information typically includes characteristics of the earth formations traversed by the wellbore in addition to data relating to the size and configuration of the borehole itself. Often, measurements are made while the wellbores are being drilled. Systems for making these measurements during a drilling operation can be described as logging-while-drilling (LWD) or measurement-while-drilling (MWD) systems, and generally include various sensors carried by a bottom hole assembly (BHA) of a drill string.

At least some of the sensors of an LWD or MWD system may be disposed as near as possible to a downhole end of the BHA to provide measurements representative of the conditions in which a drill bit is operating. Data provided by the sensors can be telemetered uphole to a surface location or to other portions of the drill string by a telemetry tool located in the BHA. The telemetry tool may communicate with a variety of technologies including, but not limited to, mud pulse, electromagnetic, and acoustic technologies. For example, a mud pulser generates pressure fluctuations in fluid flowing through a tubular string, such as drilling fluid or mud flowing through a drillstring. The pressure fluctuations are varied by the mud pulser to modulate data and/or command information on the pressure fluctuations.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
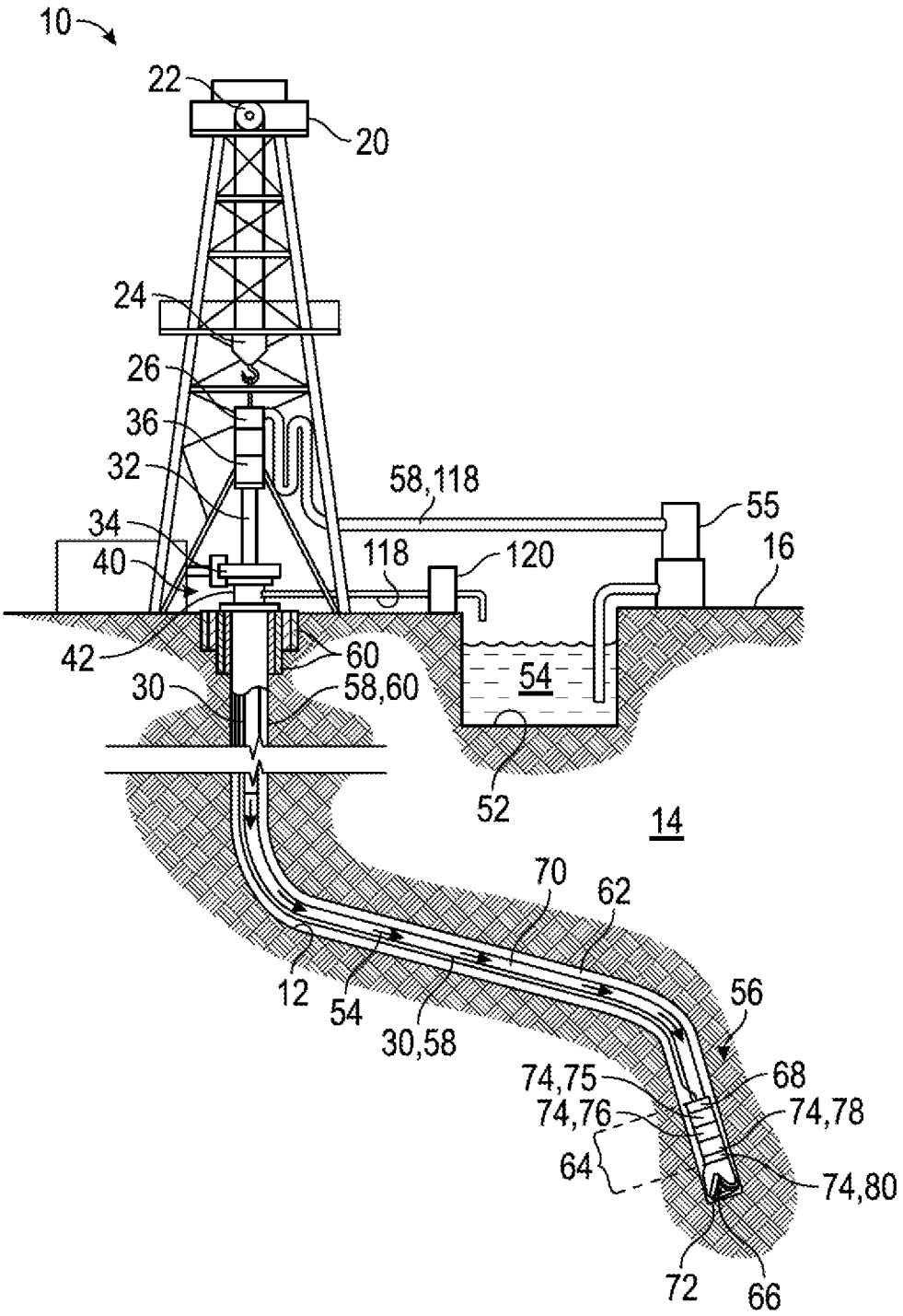
FIG. 1 is an elevation view in partial cross section of a land-based drilling system with telemetry system.

The disclosure may repeat reference numerals and/or letters in the various examples or figures. This repetition is for the purpose of simplicity and clarity and does not in itself dictate a relationship between the various embodiments and/or configurations discussed. Unless otherwise stated, the spatially relative terms are intended to encompass different orientations of the apparatus in use or operation in addition to the orientation depicted in the figures.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including vertical wellbores, slanted wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa. Further, unless otherwise noted, even though a figure may depict a cased hole, it should be understood by those skilled in the art that the apparatus according to the present disclosure is equally well-suited for use in open hole operations.

Turning to FIG. 1, shown is an elevation view in partial cross-section of a wellbore drilling and production system 10 utilized to produce hydrocarbons from wellbore 12 extending through various earth strata in an oil and gas formation 14 located below the earth's surface 16. Wellbore 12 may be formed of a single or multiple bores 12*a*, 12*b*, . . . 12*n* (illustrated in FIG. 2), extending into the formation 14, and disposed in any orientation, such as the horizontal wellbore 12*b* illustrated in FIG. 2.

Drilling and production system 10 includes a drilling rig or derrick 20. Drilling rig 20 may include a hoisting apparatus 22, a travel block 24, and a swivel 26 for raising and lowering casing, drill pipe, coiled tubing, production tubing, other types of pipe or tubing strings or other types of conveyance vehicles such as wireline, slickline, and the like 30. Conveyance vehicle 30 is a substantially tubular, axially extending drill string formed of a plurality of drill pipe joints coupled together end-to-end. Drilling rig 20 may include a kelly 32, a rotary table 34, and other equipment associated with rotation and/or translation of tubing string 30 within a wellbore 12. For some applications, drilling rig 20 may also include a top drive unit 36.

Figure 2:
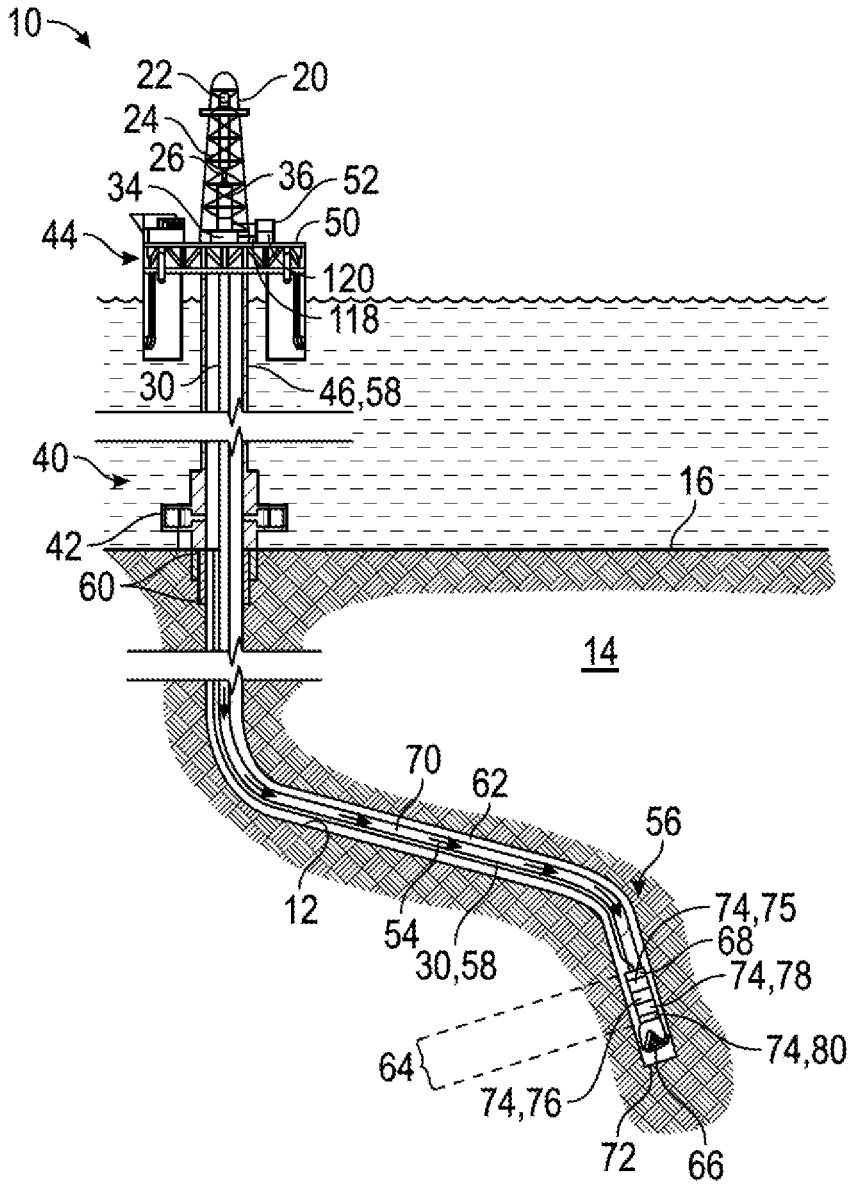
FIG. 2 is an elevation view in partial cross section of a marine-based drilling system with a telemetry system.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs), and other equipment associated with drilling or producing a wellbore may also be provided at wellhead 40 or elsewhere in the system 10.

For offshore operations, as shown in FIG. 2, whether drilling or production, drilling rig 20 may be mounted on an oil or gas platform 44, such as the offshore platform as illustrated, semi-submersibles, drill ships, and the like (not shown). Although system 10 of FIG. 2 is illustrated as being a marine-based drilling system, system 10 of FIG. 2 may be deployed on land. Likewise, although system 10 of FIG. 1 is illustrated as being a land-based drilling system, system 10 of FIG. 1 may be deployed offshore. In any event, for marine-based systems, one or more subsea conduits or risers 46 extend from deck 50 of platform 44 to a subsea wellhead 40. Tubing string 30 extends down from drilling rig 20, through subsea conduit 46 and BOP 42 into wellbore 12.

A working or service fluid source 52, such as a storage tank or vessel, may supply a working fluid 54 pumped by pump 55 to the upper end of tubing string 30 and flow through tubing string 30. Working fluid source 52 may supply any fluid utilized in wellbore operations, including without limitation, drilling fluid, cementious slurry, acidizing fluid, liquid water, steam or some other type of fluid.

Wellbore 12 may include subsurface equipment 56 disposed therein, such as, for example, a drill bit and bottom hole assembly (BHA) 64, a completion assembly or some other type of wellbore tool.

Wellbore drilling and production system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as string 30, conduit 46, collars, and joints, as well as the wellbore 12 and laterals in which the pipes, casing and strings may be deployed. In this regard, pipe system 58 may include one or more casing strings 60 that may be cemented in wellbore 12, such as the surface, intermediate and production casings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

Where subsurface equipment 56 is used for drilling and conveyance vehicle 30 is a drill string, the lower end of drill string 30 may include BHA 64, which may carry at a distal end a drill bit 66. During drilling operations, weight-on-bit (WOB) is applied as drill bit 66 is rotated, thereby enabling drill bit 66 to engage formation 14 and drill wellbore 12 along a predetermined path toward a target zone. In general, drill bit 66 may be rotated with drill string 30 from rig 20 with top drive 36 or rotary table 34, and/or with a downhole mud motor 68 within BHA 64. The working fluid 54 pumped to the upper end of drill string 30 flows through the interior flow passage 70 of drill string 30, through bottom hole assembly 64, and exit from nozzles formed in drill bit 66. At bottom end 72 of wellbore 12, drilling fluid 54 may mix with formation cuttings, formation fluids and other downhole fluids and debris. The drilling fluid mixture may then flow upwardly through an annulus 62 to return formation cuttings and other downhole debris to the surface 16.

Bottom hole assembly 64 and/or drill string 30 may include various other tools 74, including a telemetry tool 75, a power source 76, mechanical subs 78 such as directional drilling subs, and measurement equipment 80, such as measurement while drilling (MWD) and/or logging while drilling (LWD) instruments, detectors, circuits, or other equipment to provide information about wellbore 12 and/or formation 14, such as logging or measurement data from wellbore 12. Measurement data and other information from tools 74 may be communicated using electrical signals, acoustic signals or other telemetry that can be converted to electrical signals at the rig 20 to, among other things, monitor the performance of drilling string 30, bottom hole assembly 64, and associated drill bit 66, as well as monitor the conditions of the environment to which the bottom hole assembly 64 is subjected.

Fluids, cuttings and other debris returning to surface 16 from wellbore 12 are directed by a flow line 118 to storage tanks 52 and/or processing systems 120, such as shakers, centrifuges and the like.

Figure 3:
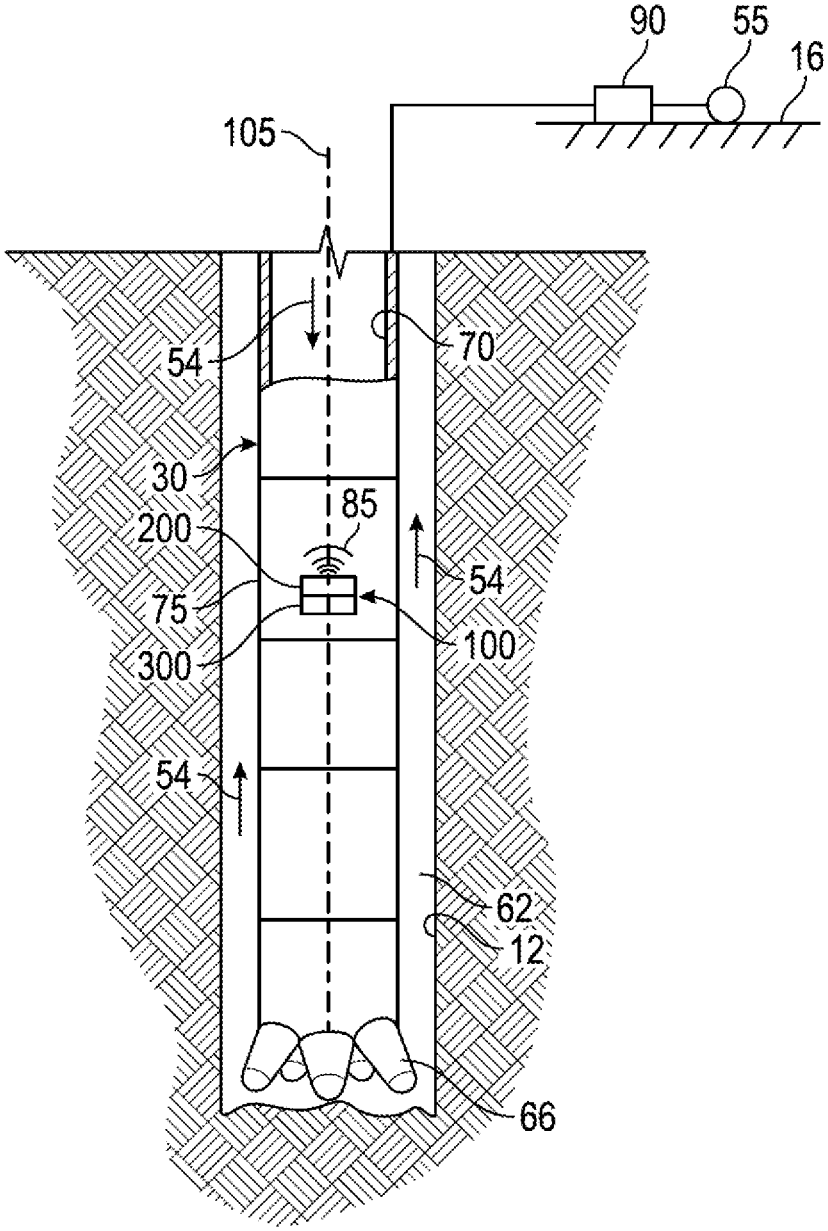
FIG. 3 is an elevation view in partial cross section of a portion of the drilling system of FIGS. 1 and 2 with the telemetry system including an actuator system.

Shown deployed in FIGS. 1 and 2 is telemetry tool 75 for generating pressure pulses. Turning now to FIG. 3, showing an elevation view in partial cross section of a portion of the drilling systems of FIGS. 1 and 2, features of the telemetry tool 75 may be discussed relative to a central axis 105 of an actuator system 100. Actuator system 100 generally includes a valve assembly 200 and an actuator assembly 400. The actuator assembly 400 of the telemetry tool 75 produces pressure fluctuations 85 in the fluid 54 as it flows through interior flow passage 70 extending longitudinally through the tubular string 30. The pressure fluctuations 85 produced by the actuator assembly 400 may cause the valve assembly 200 to intermittently restrict the flow of the fluid 54 through the passage 70. The pressure fluctuations 85 may be detected at the surface 16 by a receiver 90 (for example, including a pressure sensor), and the information modulated on the pressure fluctuations is decoded. In some examples, the receiver 90 could instead, or in addition, include a transmitter for producing pressure fluctuations to be transmitted downhole, in which case a receiver may be included in the tubular string 30. The scope of this disclosure is not limited to transmission of sensor data to the surface; transmission of other types of information (such as commands, etc.) may be performed, and the information may be transmitted in any direction via the pressure fluctuations 85.

Figure 4:
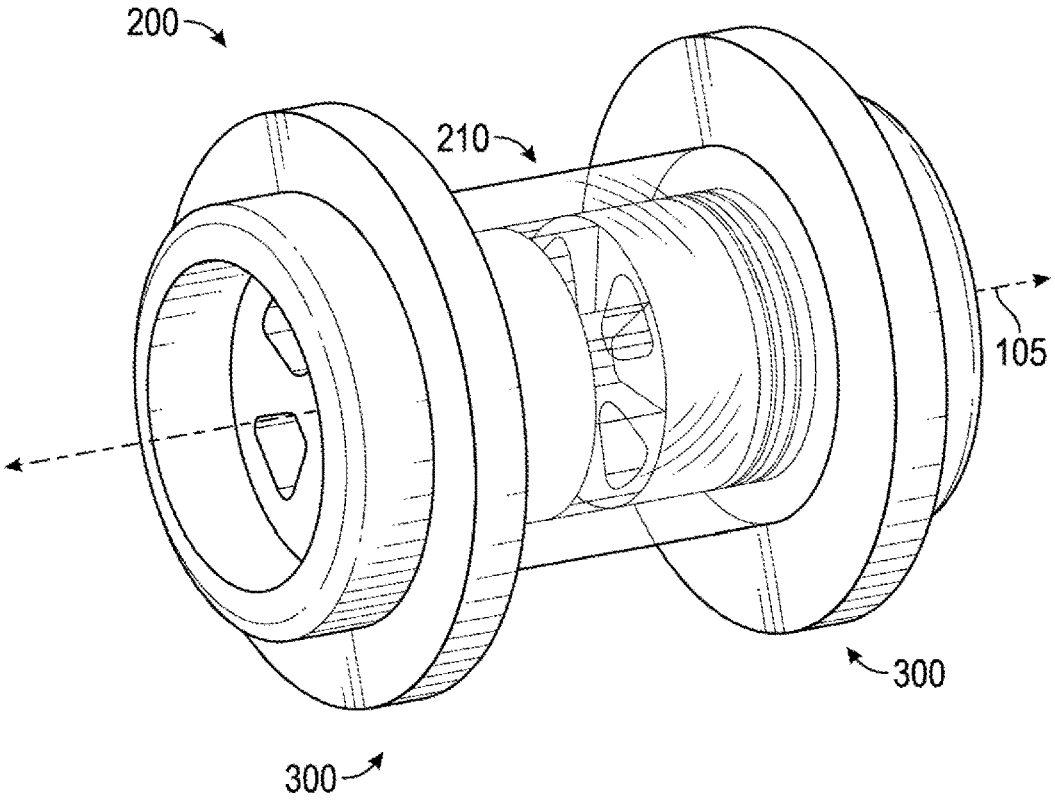
FIG. 4 is a schematic isometric view of a valve assembly of the actuator system shown in FIG. 3.
Figure 5:
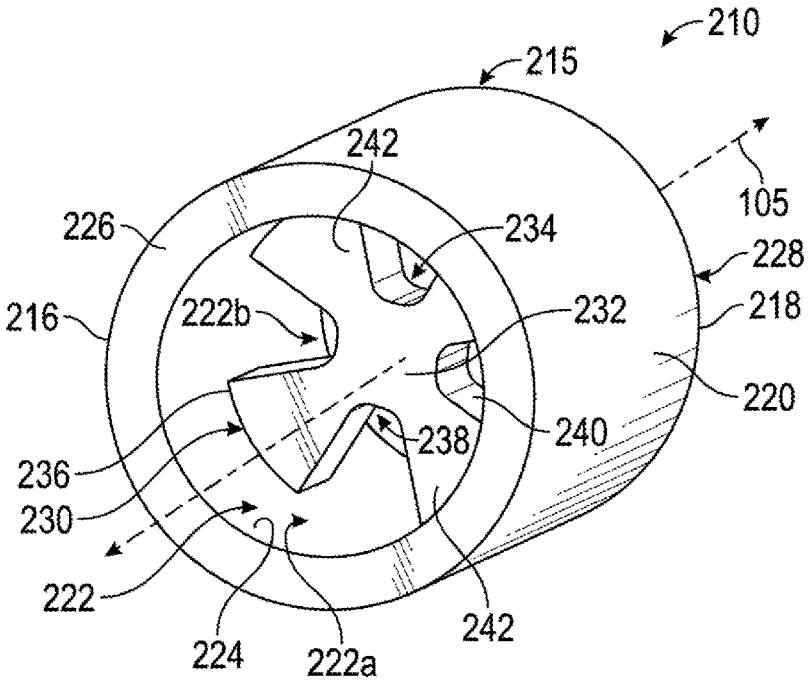
FIG. 5 is a schematic isometric view of a rotor main body of the valve assembly shown in FIG. 4.

Referring now to FIG. 4, shown is a schematic isometric view of the valve assembly 200. The valve assembly 200 is disposed along central axis 105 and comprises a rotor assembly 210 and a stator assembly 300. The rotor assembly 210 includes a main body 215, which is shown in more detail in FIG. 5. The main body 215 is generally cylindrical, has a first end 216 axially spaced from a second end 218 with a cylindrical outer surface 220 extending axially therebetween, and a through bore 222 with a cylindrical inner surface 224. A first annular surface 226 extends radially between the outer and inner cylindrical surfaces 220, 224, respectively, at first end 216, and a second annular surface 228 extends radially between the outer and inner cylindrical surfaces 220, 224, respectively, at second end 218. An internal blade 230 is disposed in through bore 222 of the rotor main body 215 and may be spaced midway between the rotor main body 215 first and second ends 216, 218, respectively, to divide the through bore 222 into a first bore 222*a* and a second bore 222*b*. The internal blade 230 has a first side 232 and a second side 234 that are disposed orthogonal to axis 105. Internal blade 230 also includes a cylindrical outer surface 236 extending axially between the blade first and second sides 232, 234, respectively. In an embodiment, the blade cylindrical outer surface 236 may be in contact with the rotor main body cylindrical inner surface 234. Internal blade 230 further includes a plurality of cutouts 238 forming passageways. In the present embodiment, internal blade 230 has four cutouts 238 spaced equally and radially about axis 105. Each cutout 238 forms an angular surface 240 extending between first and second sides 232, 234, respectively, that begins and terminates at internal blade outer cylindrical surface 236 to form spokes 242 radiating from central axis 105. In an embodiment, the four cutouts 238 may be spaced in a manner that is not equally and radially about axis 105; further, internal blade 230 may include fewer or more than four spokes 242, which may or may not be spaced equally and radially about axis 105. In an embodiment, the internal blade 230 may be a separate piece from the rotor main body 215 and disposed in the main body through bore 222. In another embodiment, the rotor main body 215 with internal blade 230 may be one piece.

Figure 6:
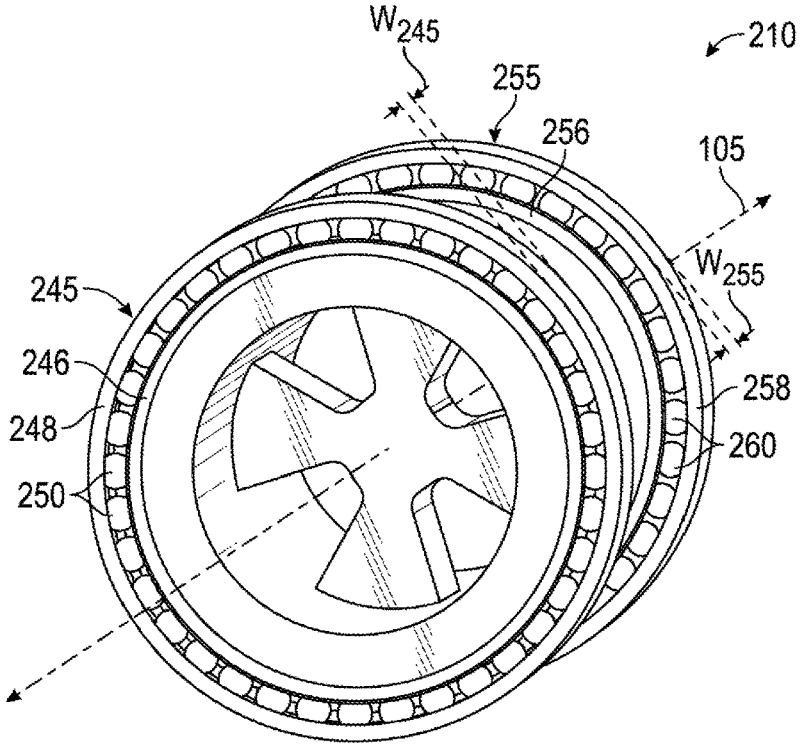
FIGS. 6 and 7 are schematic isometric and front views, respectively, of a rotor assembly of the actuator system shown in FIG. 3.
Figure 7:
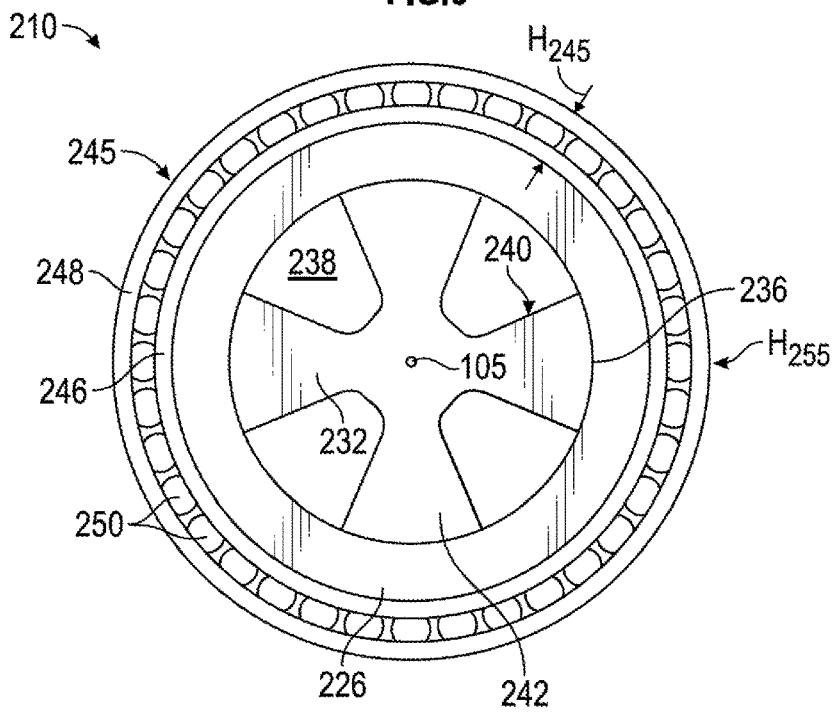

FIGS. 6 and 7 are schematic isometric and front views, respectively, of the rotor assembly 210. The rotor assembly 210 may also include a pair of bearing assemblies; a first bearing assembly 245 disposed proximate rotor first end 216 and a second bearing assembly 255 disposed proximate rotor second end 218. Each bearing assembly 245, 255 generally includes an inner race 246, 256, respectively, an outer race 248, 258, respectively, and ball bearings 250, 255, respectively. Bearing assemblies 245, 255 may be any suitable bearing assembly standard in the art that is commercially available and provides annular contact. In an embodiment, each bearing assembly 245, 255 has approximately the same width $W_{245}$, $W_{255}$ (FIG. 6) and the same height $H_{245}$, $H_{255}$ (FIG. 7).

Figure 8:
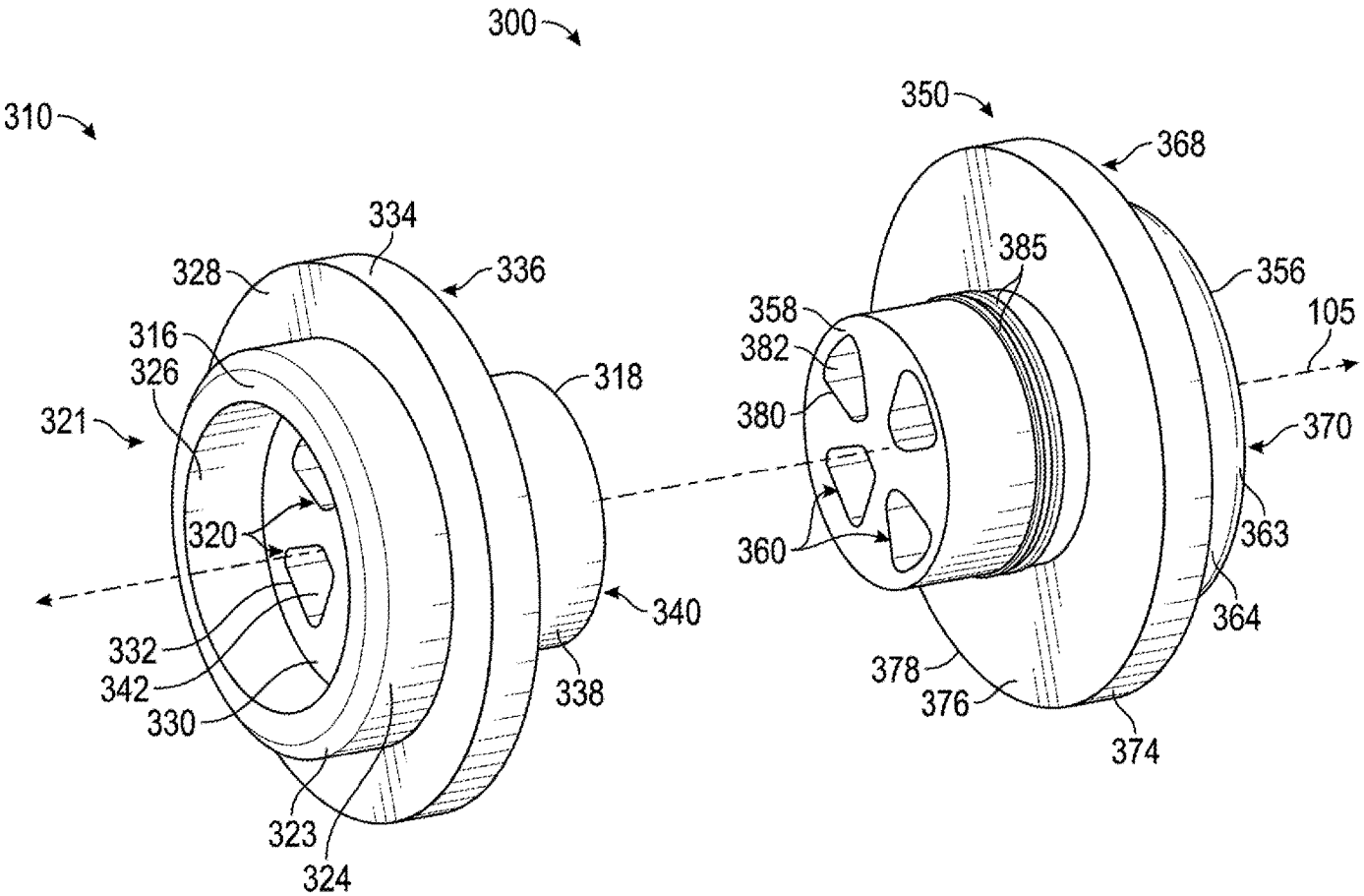
FIGS. 8 and 9 are exploded schematic isometric and side views, respectively, of a stator assembly of the valve assembly shown in FIG. 4.
Figure 9:
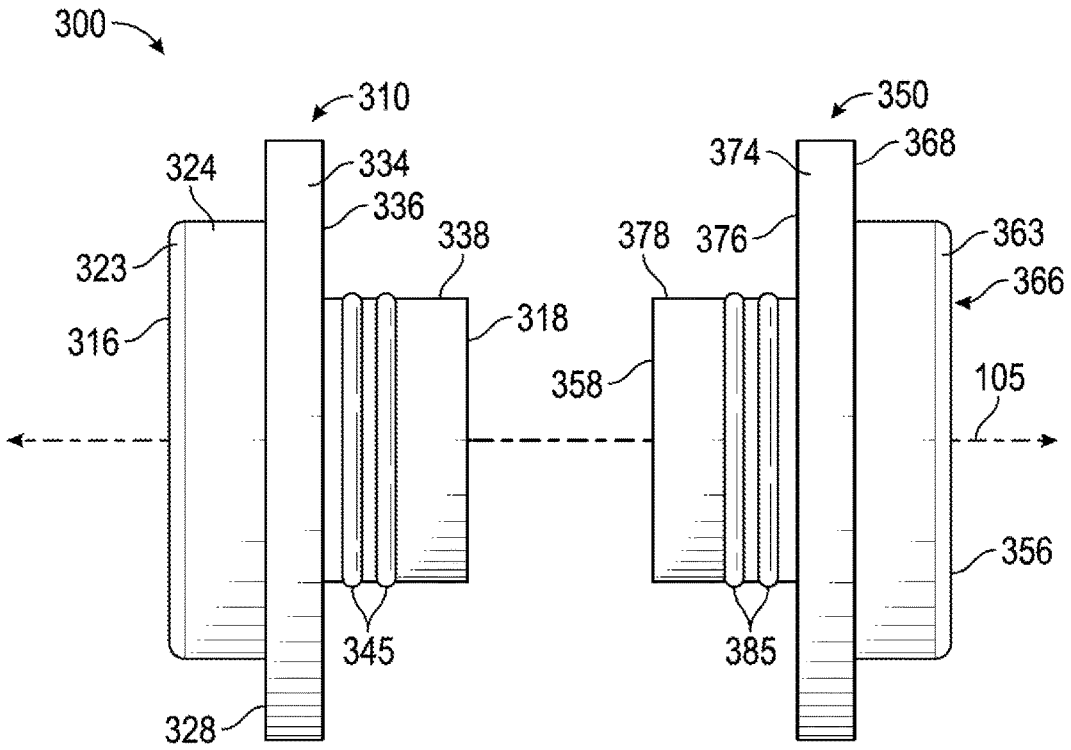

FIGS. 8 and 9 are exploded isometric and side views, respectively, of a stator assembly 300. The stator assembly 300 is disposed along central axis 105 and comprises a first stator component 310 and a second stator component 350. The first and second stator 310, 350, respectively, are similarly labeled and all references to components on the first and second stators 310, 350 will include corresponding reference numerals for both the first and second stator 310, 350 unless otherwise indicated. The first and second stator 310, 350 each has a first end 316, 356, a second end 318, 358, and a plurality of through bores 320, 360. The first end 316, 356 includes an annular portion 321, 361 having an annular surface 322, 362 that extends radially between a first outer cylindrical surface 324, 364 and an inner cylindrical surface 326, 366. The first outer cylindrical surface 324, 364 extends axially from first end 316, 356 to first annular shoulder 328, 368, and the inner cylindrical surface 326, 366 extends axially from first end 316, 356 to interior surface 330, 370 having a plurality of openings 332, 372. The first outer cylindrical surface 324, 364 may further include a rounded bevel edge 323, 363 at first end 316, 356. In an embodiment, the interior surface 330, 370 may be axially aligned with first annular shoulder 328, 368, may axially extend beyond first annular shoulder 328, 368, or may be axially recessed in relation to first annular shoulder 328, 368.

A second outer cylindrical surface 334, 374 extends axially from the first annular shoulder 322, 362 to a second annular shoulder 336, 376. Further, a third cylindrical surface 338, 378 extends axially from the second annular shoulder 336, 376 to the second end 318, 358, which includes a plurality of openings 340, 380. The plurality of through bores 320, 360 extends axially from the interior surface 330, 370 to the second end 318, 358, connecting openings 332, 372, and 340, 380, respectively, and forming passages with surfaces 342, 382. The third cylindrical surface 338, 378 further includes a seal 345, 385 disposed proximate second annular shoulder 336, 376. In the present embodiment, each stator third cylindrical surface 338, 378 includes two seals 345, 385 spaced apart and disposed proximate second annular shoulder 336, 376. In other embodiments, fewer or more seals 345, 387 may be included. Further, seals 345, 385 may be disposed in an annular groove (not shown) on third cylindrical surface 338, 378. In the present embodiment, each stator 310, 350 includes four through bores 320, 360 that are equally-sized and spaced equally and radially about axis 105. The pattern of the through bores 320, 360 may further be derived from the topology of the rotor cutouts 238. In another embodiment, stators 310, 350 may each include fewer or more through bores 320, 360 that may or may not be equally-sized or spaced equally and radially about axis 105.

Figure 10:
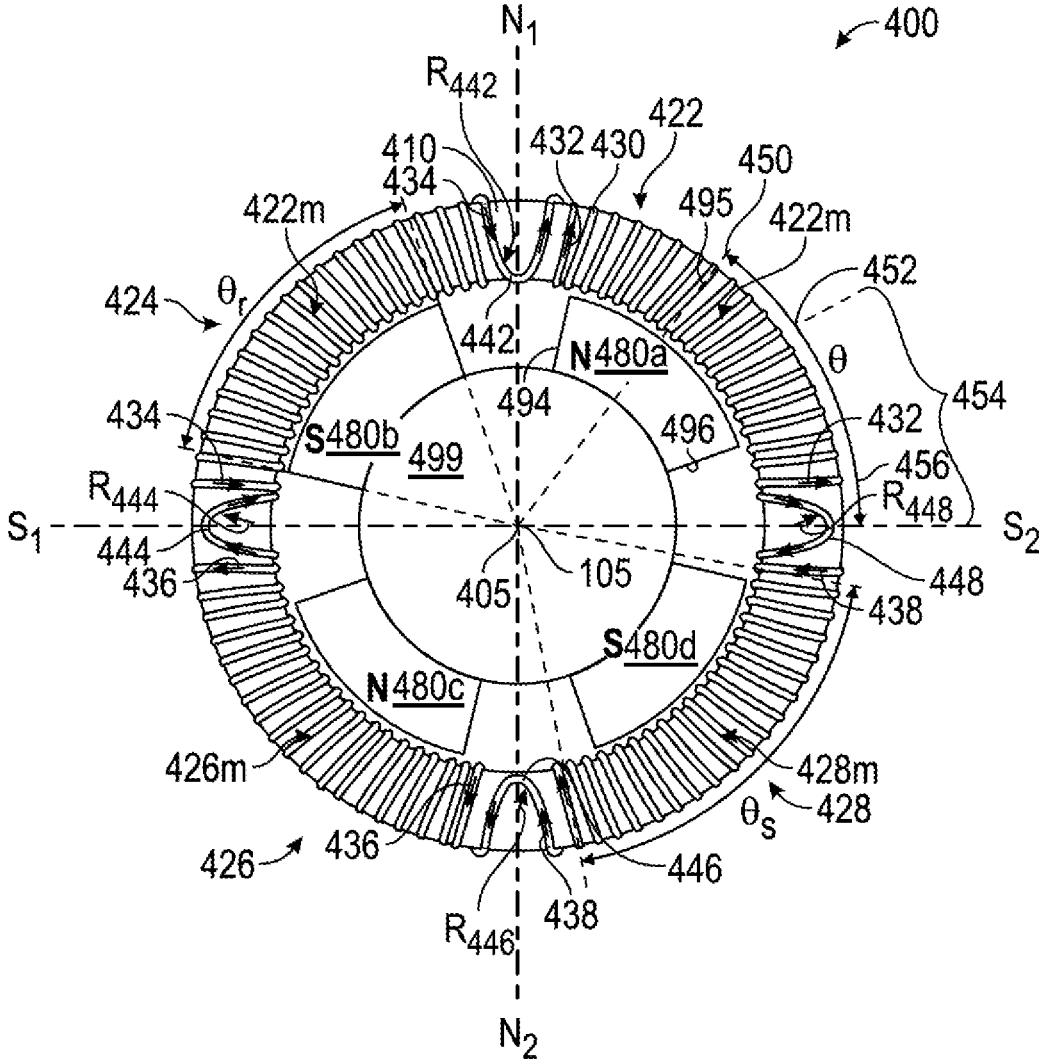
FIG. 10 is a schematic view of an actuator assembly of the actuator system shown in FIG. 4.
Figure 11:
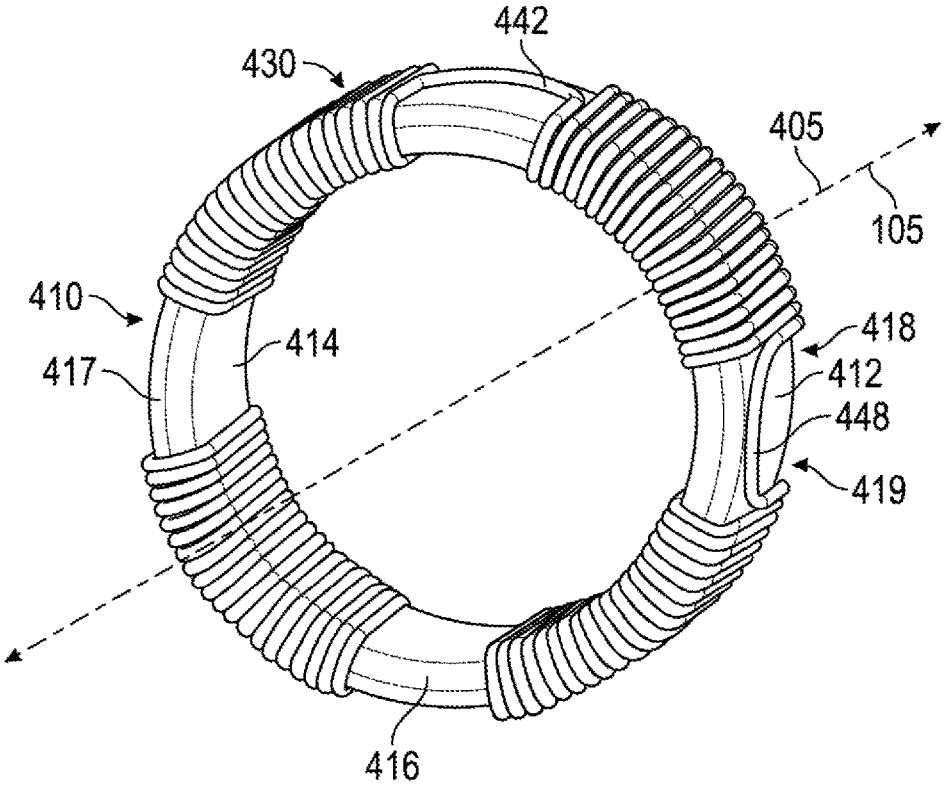
FIGS. 11 and 12 are schematic isometric and side views of a core and winding of the actuator assembly shown in FIG. 10.
Figure 12:
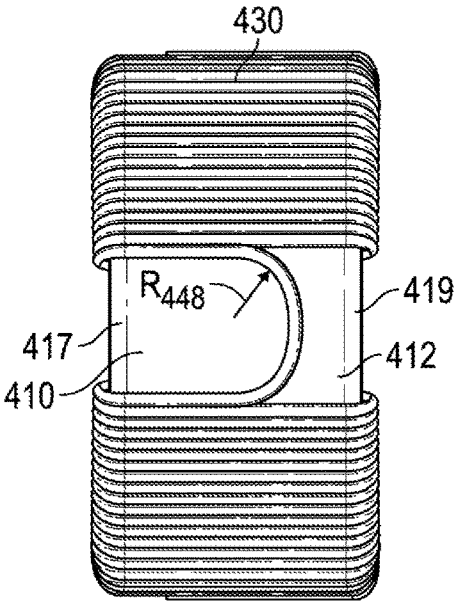

FIG. 10 is a schematic view of the actuator assembly 400. The actuator assembly 400 comprises a core 410, a winding 430, and a plurality of magnets 480. The core 410 is generally tubular and shaped like a solid toroid having a generally rectangular cross-section disposed about a central axis 405. FIGS. 11 and 12 show the core 410 and winding 430 of the actuator system 400 in isometric and side views, respectively. The core 410 has an outer cylindrical surface 412, an inner cylindrical surface 414, a first annular side 416, and a second annular side 418. The core 410 may further include beveled edges 417, 419, respectively, between the outer cylindrical surface 412 and the first and second annular sides 416, 418, respectively. Referring back to FIG. 10, in the present embodiment, central axis 405 is coincident with axis 105, and the core may be described as having four portions or quadrants: a first portion 422, a second portion 424, a third portion 426, and a fourth portion 428. Each portion 422, 424, 426, 428 may further be described as having a midpoint 422*m*, 424*m*, 426*m*, 428*m*, respectively. These portions and midpoints are intended to aid in describing the components; fewer or more portions may also be described.

Referring still to FIG. 10, the winding 430 comprises a coil of wire and is toroidally wound around the core 410. Any suitable wire with a suitable gauge known in the art may be used for winding 430. In an embodiment, the winding 430 may wrap around the core 410 in a first direction (represented by arrow 432) across the first core portion 422. Where the first and second portions 422, 424, respectively, meet, the winding 430 may form a first U shape 442 to change the direction of the winding 430. The winding 430 may wrap around the core 410 in a second direction (arrow 434) across the second core portion 424. Where the second and third portions 424, 426, respectively, meet, the winding 430 may further form a second U shape 444 to change the direction of the winding 430. The winding 430 may wrap around the core 410 in a third direction (arrow 436) across the third core portion 426. Where the third and fourth portions 426, 428, respectively, meet, the winding 430 may further form a third U shape 446 to change the direction of the winding 430. The winding 430 may wrap around the core 410 in a fourth direction (arrow 438) across the fourth core portion 428. Where the fourth and first portions 428, 422, respectively, meet, the winding 430 may further form a fourth U shape 448 to change the direction of the winding 430. In an embodiment, the first direction represented by arrow 432 may be the same as the third direction represented by arrow 436, and the second direction represented by arrow 434 may be the same as the fourth direction represented by arrow 438. The winding 430 may be wound tightly around the core 410 such that each individual pass 430*a*, 430*b*, 430*c*, . . . 430*n* of winding 430 is in contact with, or in close proximity to, the next individual pass 430*n* of winding 430 (see, for example, FIGS. 11 and 12), or the individual windings 430*a*, 430*b*, 430*c*, . . . 430*n* may be more loosely wound around the core 410 (see, for example, FIG. 10). Similarly, the U shape 442, 444, 446, 448 may have a small or large radius of curvature $R_{442}$, $R_{444}$, $R_{446}$, $R_{448}$ (see, for example, FIGS. 10 and 12). The number of turns in winding 430 will vary depending on the desired number of electrical poles $N_1$, $S_1$, $N_2$, $S_2$.

Figure 13:
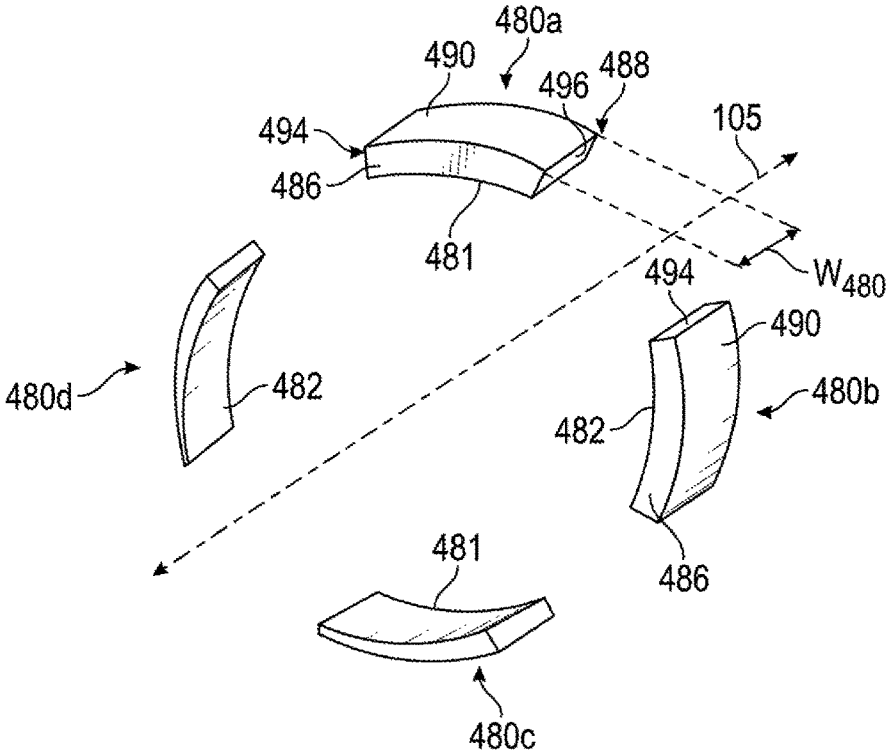
FIG. 13 is a schematic isometric view of magnets in FIG. 10.

Referring again to FIG. 10 and to FIG. 13, which shows an isometric view of the magnets 480 in FIG. 10, each magnet 480*a*, 480*b*, 480*c*, 480*d*, . . . 480*n* of the plurality of magnets 480 has a first end 486 axially spaced from a second end 488, an outer radial surface 490, an inner radial surface 492, a first side 494, and a second side 496. The outer radial surface 490 and the inner radial surface 492 each extend between the first and second ends 486, 488 and between the first side 494 and the second side 496. The magnets 480 may be disposed about a central axis, such as central axis 405, and spaced equally and radially about the central axis. Each magnet 480 may also include a centerline 495 disposed midway between the first and second sides 494, 496, respectively, and intersecting the central axis 405. The magnets may further be disposed about a cylindrical object 499 that is disposed within the core 410; for example, magnets 480 may be disposed about a rotor, such as rotor main body 215 (to be discussed in further detail below). Magnets 480 may be any suitable magnets known in the art. The magnets 480 may be grouped in pairs 481, 482; for example, in an embodiment, magnets 480*a*, 480*c* may be disposed opposite one another (across central axis 405) and be grouped in a first pair 481 of magnets 480, and magnets 480*b*, 480*d* may be disposed opposite one another (across central axis 405) and be grouped in a second pair 482 of magnets 480. Each pair 481, 482 may further be configured to have matching polarities; for example, the outer radial surfaces 490*a*, 490*c* of magnets 480*a*, 480*c* may both be north poles $N_{480a}$, $N_{480c}$ of the magnets 480*a*, 480*c*, and the outer radial surfaces 490*b*, 490*d* of magnets 480*b*, 480*d* may both be south poles $S_{480b}$, $S_{480d}$ of the magnets 480*b*, 480*d*. In an embodiment, one pair of magnets 480 may be used, and in yet further embodiments, more than two pairs of magnets 480 may be used. In another embodiment, each magnet 480 may be replaced with multiple magnets 480 spaced axially apart along rotor main body 215. The magnets 480 may be staggered or aligned about central axis 405 relative each other.

Figure 14:
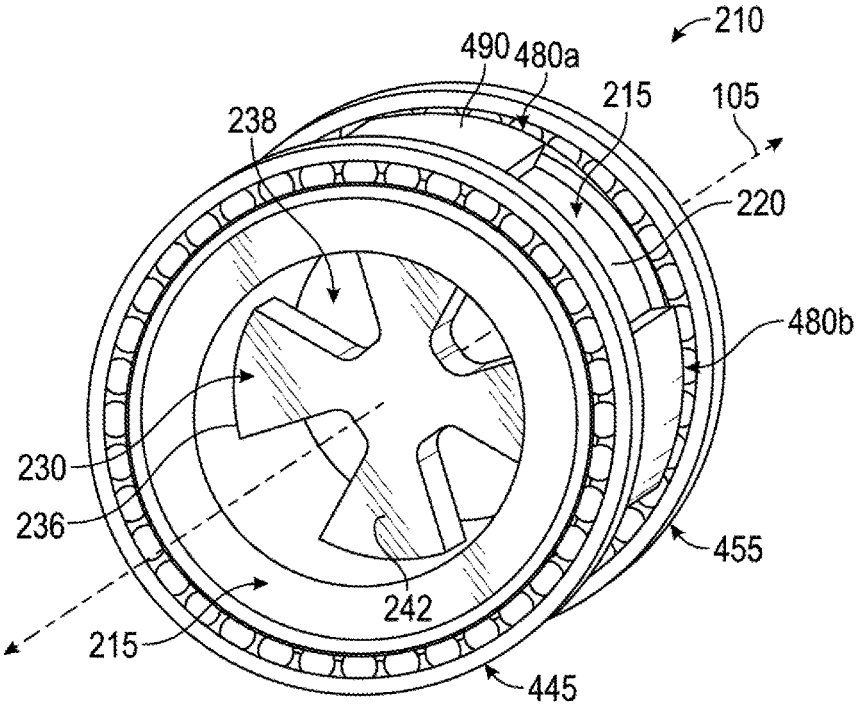
FIGS. 14 and 15 are schematic isometric and side views, respectively, of the rotor assembly of FIG. 6 with the magnets of FIG. 13.
Figure 15:
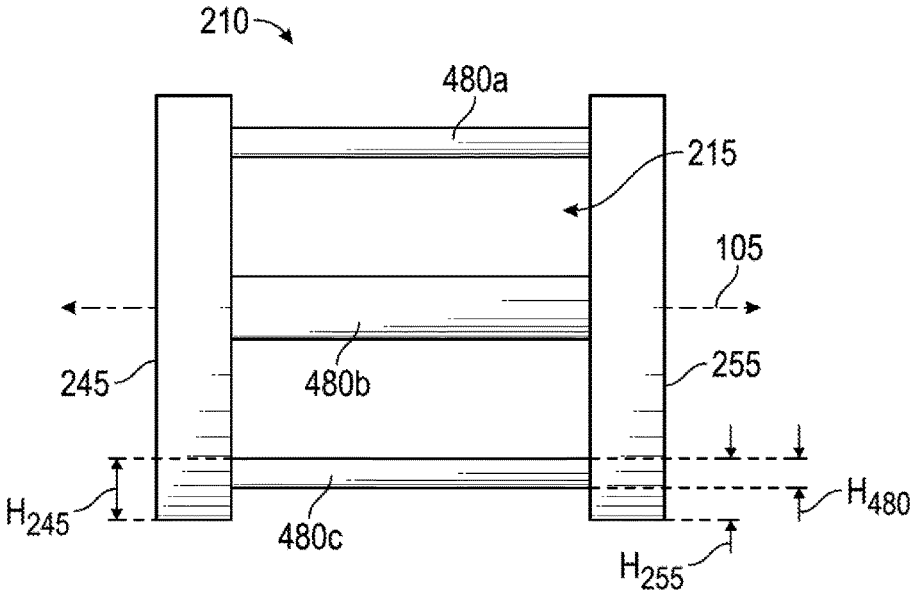

FIGS. 14 and 15 are isometric and side views, respectively, of the rotor 210 with magnets 480 and bearings 245, 255. In an embodiment, the magnets 480*a*, 480*b*, 480*c*, 480*d* are disposed on rotor main body 215 such that the inner radial surface 492 of each magnet 480 is disposed on and in contact with the cylindrical outer surface 220 of the rotor main body 215 and may be spaced equally and radially about central axis 105. Each magnet 480 may further be positioned on the cylindrical outer surface 220 of the rotor main body 215 such that each magnet 480 is axially aligned with the blade 230 of rotor main body 215. In particular, each magnet 480 may be radially aligned with the individual spokes 242 of blade 230. Each magnet 480 may be positioned on rotor main body 215 to correspond to the number and orientation of electrical poles $N_1$, $S_1$, $N_2$, $S_2$ of the core 410 and winding 430. Each magnet 480 may have any width $W_{480}$ that fits within bearing assemblies 245, 255 without impeding function and any height $H_{480}$ equal to or less than the height $H_{245}$, $H_{255}$, respectively, of the bearing assemblies 245, 255 (FIG. 15). In other embodiments, the magnets 480 may be disposed on cylindrical outer surface 220 of the rotor main body 215 offset closer to the rotor main body first end 216 or closer to the rotor main body second end 218.

In an embodiment, the core 410, winding 430, magnets 480, and rotor 210 operate like a limited angle torque motor to electromagnetically produce torque. An electrical current may be passed through the winding 430 and produces electrical poles $N_1$, $S_1$, $N_2$, $S_2$ where the winding 430 reverses direction. For example, as shown in FIG. 10, north poles $N_1$, $N_2$, and south poles $S_1$, $S_2$ are formed by reversing the winding 430; thus, each pole $N_1$, $S_1$, $N_2$, $S_2$, respectively, corresponds to a U shape 442, 444, 446, 448, respectively, in winding 430, where the direction of the winding 430 is reversed. The magnets 480 may be mounted on the rotor main body 215 and correspond to the number and orientation of the electrical poles $N_1$, $S_1$, $N_2$, $S_2$. The number of poles $N_1$, $S_1$, $N_2$, $S_2$ influences the angle of rotation of the valve assembly 200, or extrusion angle θ. For example, if the winding 430 reverses direction two times, there are two poles and the maximum excursion angle θ is ±90 degrees; similarly, if the winding 430 reverses direction four times, there are four poles and the maximum excursion angle θ is ±45 degrees (as shown in FIG. 10); and if the winding 430 reverses direction eight times, there are eight poles with a maximum excursion angle θ of ±22.5 degrees.

Figure 16:
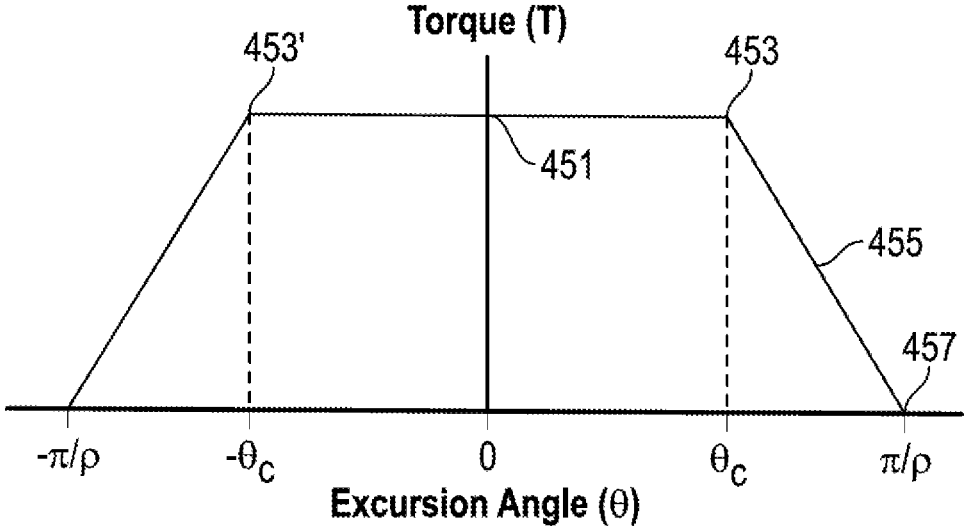
FIG. 16 is a chart of the relationship between the excursion angle and torque of the actuator assembly shown in FIG. 10.

Referring again to FIG. 10, the magnetic fields from the electrical current passing through the winding 430 interacts with the magnets 480 on the rotor main body 215 to produce a rotational torque T. This torque T rotates the rotor main body 215 over the excursion angle θ. A similar analogy can be used to describe the case for a negative excursion angle −θ, where the current through the stator winding is reversed. The relationship between the excursion angle θ and the torque T is shown in FIG. 16. In the embodiment shown in FIG. 10, when the centerline 495 of a magnet 480 (480*a*, for example) is aligned with a core midpoint (422*m*, for example) that is midway between opposing poles ($N_1$, $S_2$, for example), the excursion angle θ is zero and the torque T is at a maximum, represented by reference numerals 450 in FIGS. 10 and 451 in FIG. 16. The torque T remains constant until the excursion angle θ reaches the maximum angle θc (or −θc for a negative excursion angle −θ) at which constant torque can be maintained, represented by reference numerals 452 in FIG. 10 and 453 (or 453') in FIG. 16. For angles greater than the maximum excursion angle for constant torque θc, (or −θc), the torque T drops linearly as the magnet 480 moves closer to and aligns with an electrical pole of opposite polarity, where the torque T becomes zero; this angle may be calculated by dividing pi π by the number of electrical poles ρ. For example, in the embodiment shown in FIG. 10, as the centerline 495 of magnet 480*a* with outer radial surface 490*a* configured as a north pole $N_{480a}$ moves from midpoint 422*m* toward the south pole $S_2$ at U shape 448, the torque T drops linearly, represented by arc portion 454 in FIG. 10 and line 455 in FIG. 16; and when the centerline 495 becomes aligned with the south pole $S_2$ at U shape 448, the torque T is zero, represented by reference numerals 456 in FIGS. 10 and 457 in FIG. 16.

Figure 17:
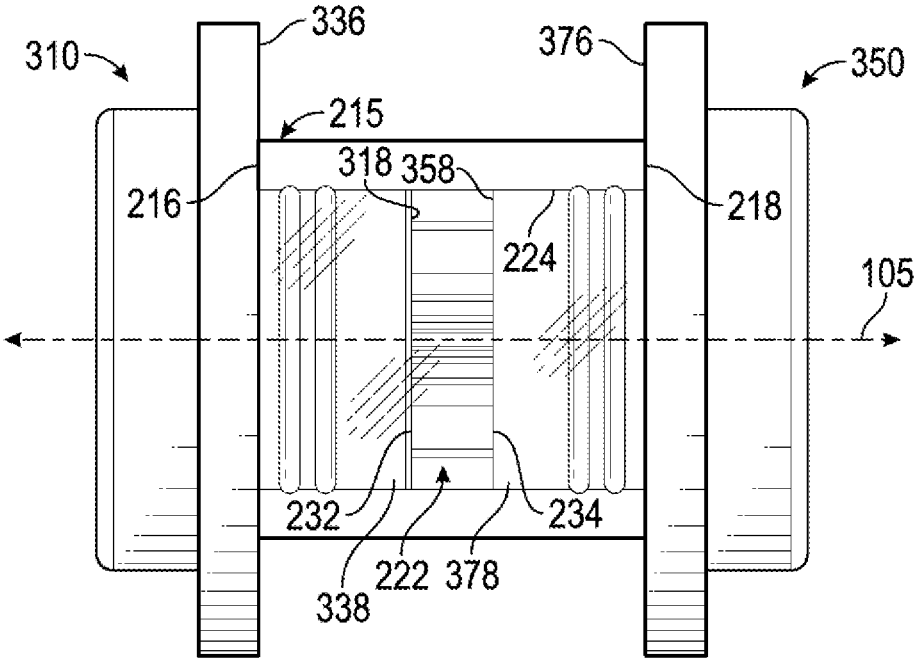
FIG. 17 is a schematic side view of the valve and actuator assemblies shown in FIG. 3.

FIG. 17 is a partial cross-sectional view of the valve assembly 200, showing the rotor assembly 210 and the stator assembly 300. The first and second stator 310, 350 engage the rotor 210 such that a portion of each stator 310, 350 is disposed in the through bore 222 of the rotor main body 215. In particular, the third cylindrical surface 338, 378 of each stator 310, 350 is disposed at least partially in rotor first and second bores 222*a*, 222*b*, respectively (shown in FIG. 4). The stator second end 318, 358 may be adjacent to, in contact with, or spaced away from the internal blade first and second sides 232, 234, respectively, of the rotor.

Figure 18:
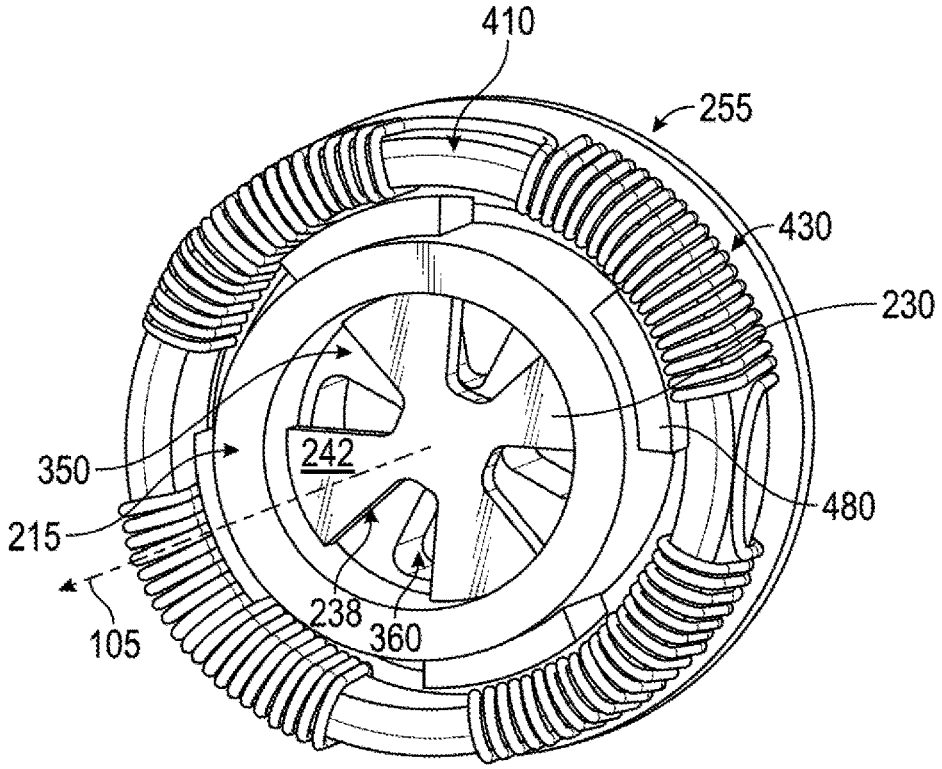
FIG. 18 is a schematic, isometric, partial cross-sectional view of the actuator system.
Figure 19:
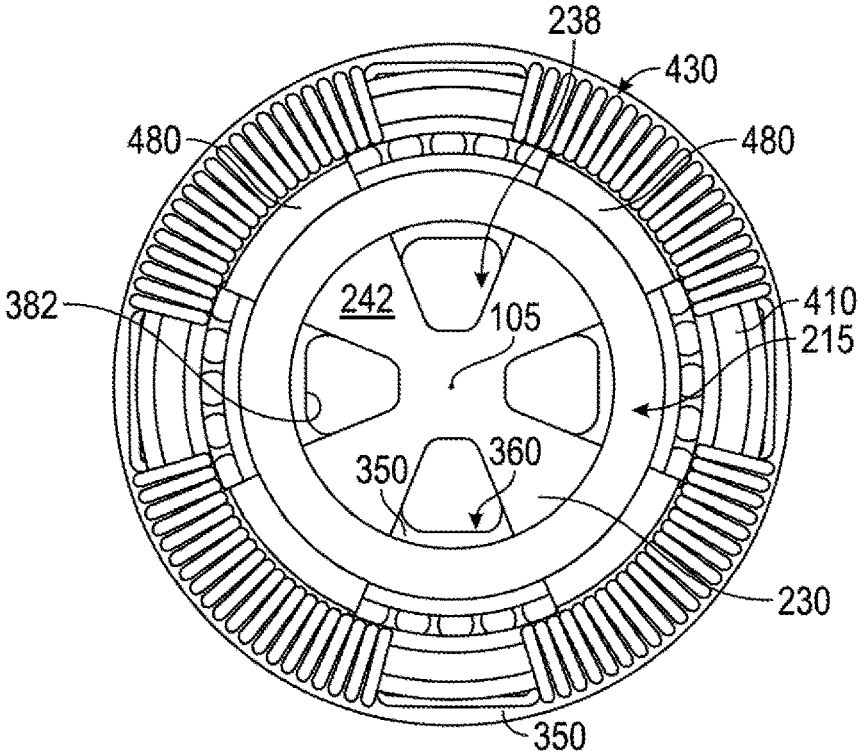
FIGS. 19 and 20 are schematic front views of the valve and actuator assemblies with the valve assembly disposed in different positions.
Figure 20:
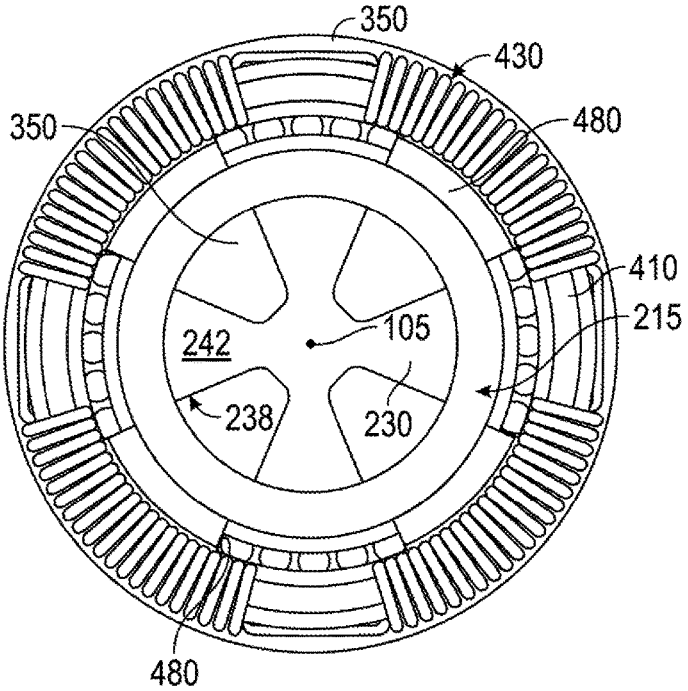

FIG. 18 is a schematic, isometric, partial cross-sectional view of the valve and actuator assemblies 200, 400, respectively, showing the rotor assembly 210, the second stator 350, the core 410, and the winding 430. FIGS. 19 and 20 are schematic side views of the valve and actuator assemblies 200, 400, respectively, shown in FIG. 18 with the rotor main body 215 disposed in two different positions. The cutouts 238 in the rotor internal blade 230 are configured and arranged to align with the through bores 320, 360 in the stators 310, 350, and to rotate about central axis 105 relative the stators 310, 350. In an embodiment, the through bores 320, 360 in the stators 310, 350 may be approximately the same size, larger, or smaller than the cutouts 238 in the rotor blade 230. The spacing between and size of each cutout 238 and each through bore 320, 360 may further be configured such that spokes 242 (portions of internal blade 230 between cutouts 238) of rotor blade 230 entirely block or cover through bores 320, 360 in the stators 310, 350, and vice versa; the cutouts 238 in rotor blade 230 may be entirely blocked or covered by the portions of the stators between through bores 320, 360. In an alternative embodiment, the rotor cutouts 238 and stator through bores 320, 360 may be sized and configured such that at least a portion of one of the cutouts 238 is always in fluid communication with one of the through bores 320, 360. In another embodiment, the cutouts 238 and through bores 320, 360 may be asymmetrically sized and/or spaced asymmetrically about central axis 105.

Referring again to FIG. 17, in the present embodiment, rotor first and second ends 216, 218, respectively, are in contact with, or close proximity to, the second annular shoulders 336, 376 of the first and second stators 310, 350, respectively; the internal blade first and second sides 232, 234 of the rotor main body 215 are in contact with, or close proximity to, the second ends 318, 358, respectively of the first and second stators 310, 350, respectively; and the cylindrical inner surface 224 of the rotor main body 215 is in contract with, or close proximity to, the third cylindrical surface 338, 378, respectively of the first and second stators 310, 350, respectively.

The rotor main body 215 may rotate about central axis 105 within the first and second stators 310, 350, respectively, while the stator assembly 300 remains stationary. The stator assembly 300 may further be fixed to a larger assembly (not shown). In a first or open position (FIG. 19), the rotor cutouts 238 are aligned with the stator through bores 320, 360 to allow fluid communication between the first and second stator through bores 320, 360 via the cutouts 238 in the rotor internal blade 230. In a second or closed position (FIG. 20), the rotor cutouts 238 are no longer aligned with the stator through bores 320, 360 and the rotor spokes 242 prevent fluid communication between the first and second stator through bores 320, 360. In other positions (FIG. 18), the rotor cutouts 238 may partially overlap the stator through bores 320, 360 to allow restricted fluid communication between the first and second stator bores 320, 360 via the cutouts 238 in the rotor internal blade 230, as shown in FIG. 18.

Figure 21:
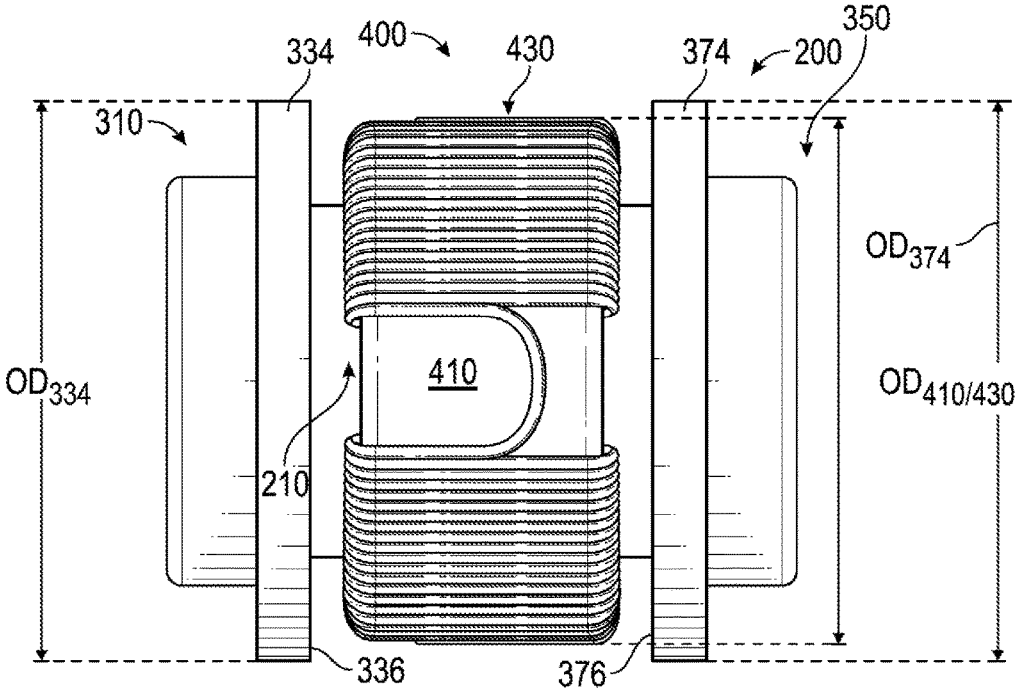
FIG. 21 is a schematic side view of the actuator system shown in FIGS. 18-20.

Referring still to FIGS. 18-20, and FIG. 21 showing a schematic side view of the actuator system in FIGS. 18-20. As previously described, the actuator assembly 400 includes a core 410, a winding 430, and a plurality of magnets 480, where the magnets 480 are disposed on rotor cylindrical outer surface 220 to operate as an electric motor, and in particular, a limited angle torque motor. Thus, the rotor 210 forms part of the electrical motor. The core 410 with winding 430 is positioned around the magnets 480, and hence around the rotor assembly 210 (FIGS. 18-20). The core 410 with winding 430 is further disposed between the stator second annular shoulders 336, 376 and has a combined outer diameter $OD_{410/430}$ that is less than the overall height or outer diameter $OD_{334}$, $OD_{374}$ of the second outer cylindrical surface 334, 374 (FIG. 21).

Figure 22:
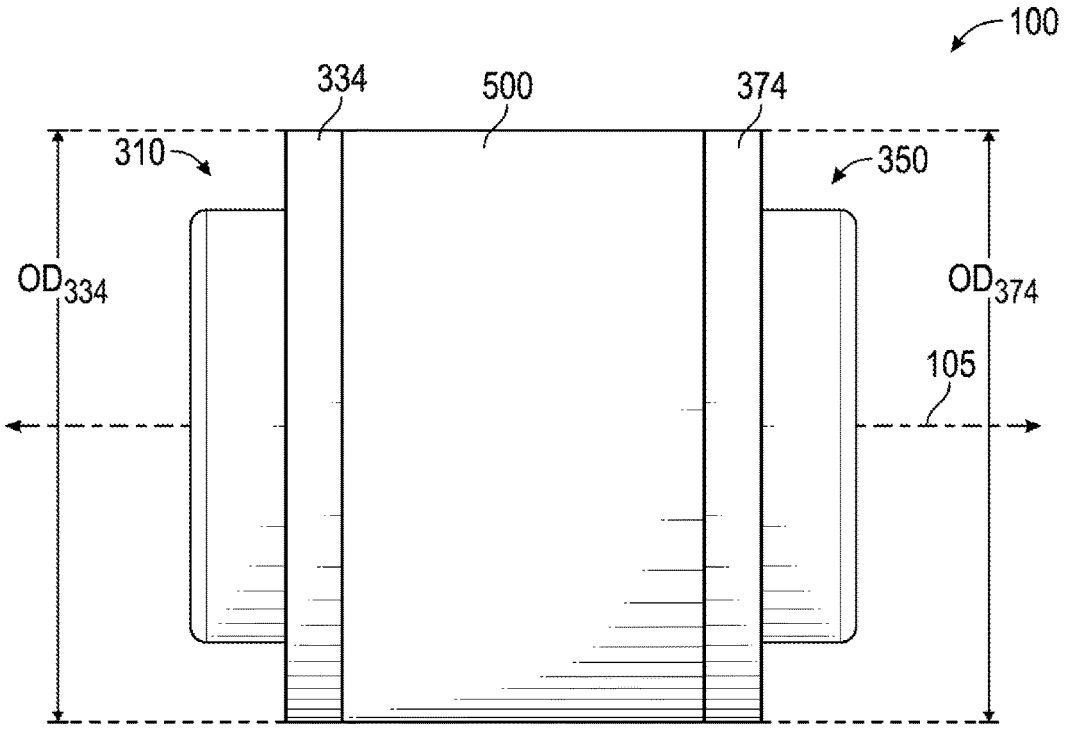
FIG. 22 is a schematic side view of the actuator system shown in FIG. 21 with a housing
Figure 23:
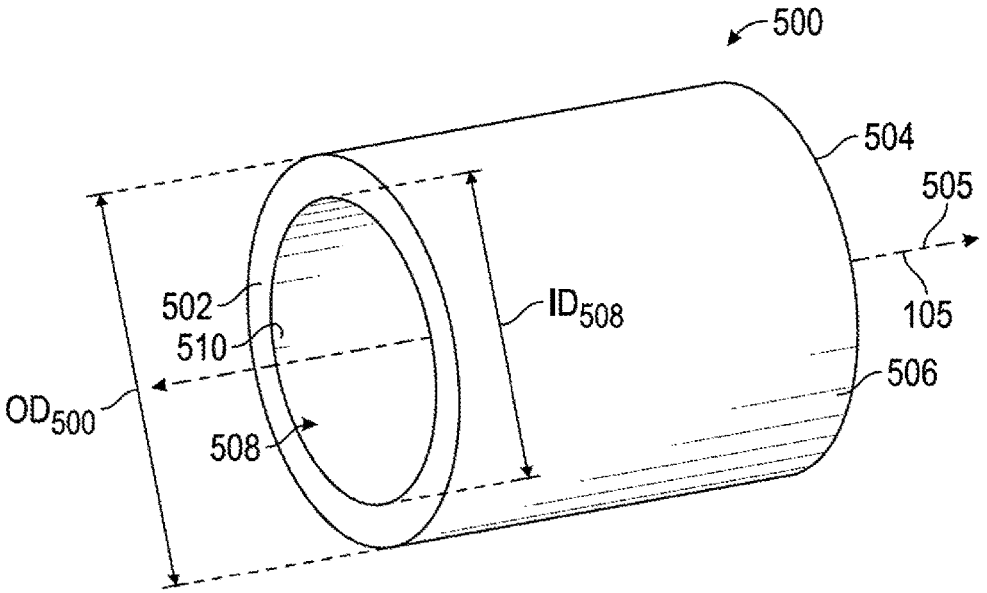
FIG. 23 is a schematic, isometric view of the housing shown in FIG. 22.

Referring now to FIG. 22, shown is the actuator system 100 and a housing 500, which is further shown in a schematic isometric view in FIG. 23. The housing 500 is generally cylindrical and has a first end 502 axially spaced from a second end 504, an outer cylindrical surface 506, and a through bore 508 defined by an inner cylindrical surface 510. In an embodiment, the through bore 508 has an inner diameter $ID_{508}$ configured to allow the rotor assembly 210, including the bearings 245, 255 and magnets 480, and the core 410 and winding 430 to fit therein. The housing 500 may be further configured to provide support to the bearings 245, 255. Further, the outer diameter $OD_{500}$ of the housing 500 is configured to be approximately the same as the outer diameter $OD_{334}$, $OD_{374}$ of the second outer cylindrical surface of the first and second stators 310, 350.

In operation, the rotor assembly 210 reciprocatingly rotates within the stator assembly 300 in response to the actuator assembly 400 to produce pressure fluctuations 85 in the fluid 54 (see FIG. 3). For the reciprocating motion, the excursion angle θ is preferably within the range that produces a constant torque T, or any angle within the range $-\theta c \leq \theta \leq \theta c$. The maximum excursion angle for constant torque θc can be determined by dividing the difference between a stator pole arc θs and a rotor pole arc θr by 2, or $$\theta c = \frac{\theta s - \theta r}{2}$$

If the maximum rotational angle of the valve assembly 200 is known, the equation for the maximum excursion angle for constant torque θc and the chart shown in FIG. 16 may be used to determine the preferred number of poles ρ as well as the dimensions for the magnets 480 and the winding 430 orientation. Further, a positive increase in the excursion angle θ produces a positive increase in pressure in the fluid 54; the pressure returns to normal when the excursion angle θ returns to zero. The pressure may be increased again by the inertia of the rotor assembly 210. In particular, the valve may be accelerated in the opposite direction (i.e., a negative excursion angle −θ produces a positive increase in pressure), generating a wobbling valve position effect and high frequency mud pressure waveforms, and reducing the amount of power used to generate smooth continuous pressure waves.

Figure 24:
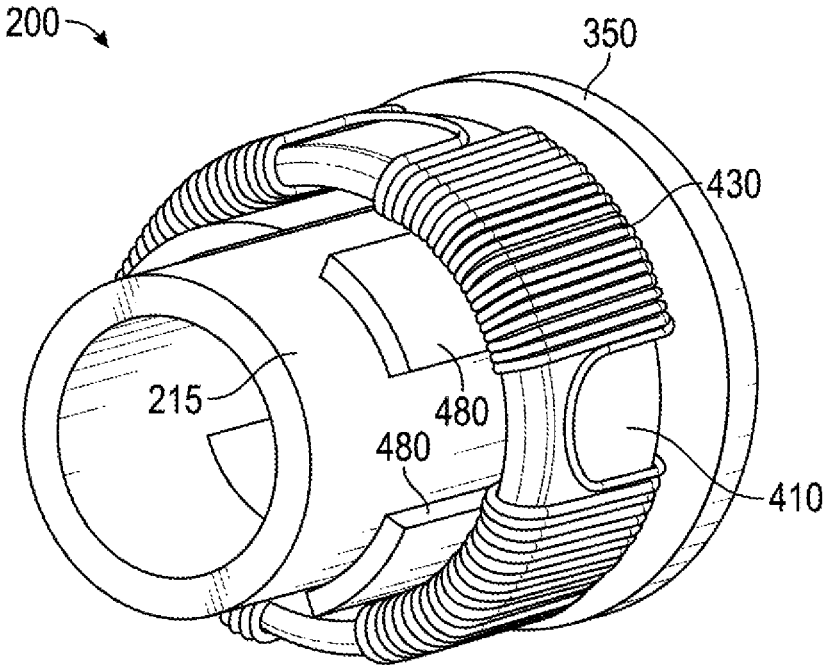
FIGS. 24-27 are schematic isometric views of alternative embodiments of the actuator system.
Figure 25:
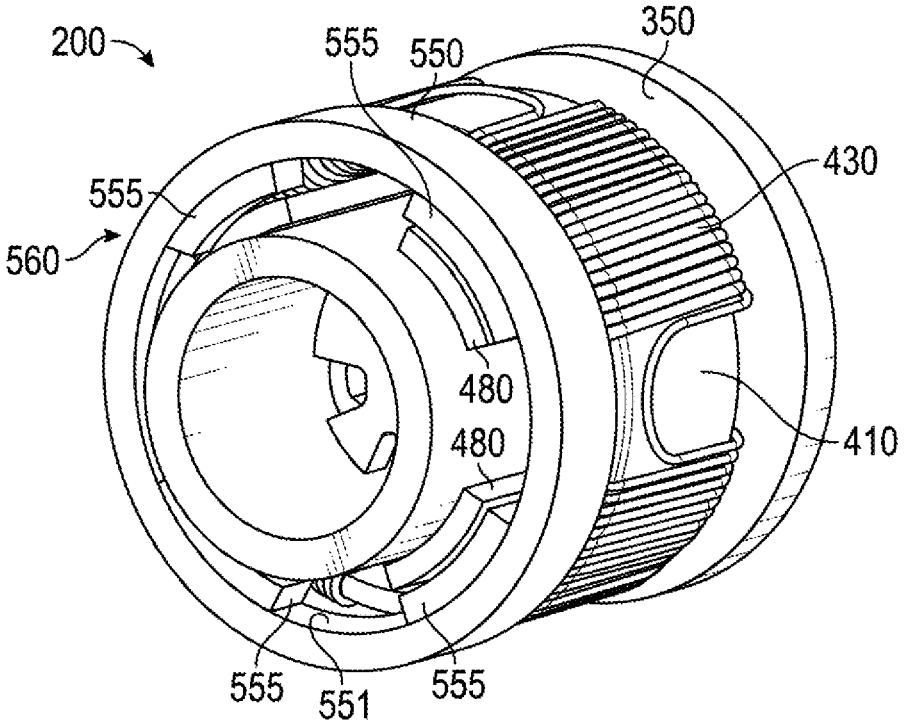

FIGS. 24 and 25 are isometric schematic views of alternative embodiments of the valve assembly 200. In an embodiment, the magnets 480 may extend beyond the width of the core 410 and winding 430 (FIG. 24). In another embodiment, the housing 500 may further include stationary magnets 555 disposed on an annular ring or stationary stator housing 550, which is disposed adjacent the core 410 and winding 430. The stationary magnets 555 may have a polarity opposite the polarity of magnets 480 disposed on the rotor main body 215 (FIG. 25). The stationary magnets 555 disposed on the stationary stator housing 550 may be aligned with the magnets 480 on the rotor main body 215, and together form a magnetic coupler 560. The magnetic coupler 560 returns the rotor 210 back to a position where the rotor cutouts 238 are aligned with the stator through bores 320, 360 when an electrical current is removed from the winding 430 (i.e., in case of an electrical failure). The magnetic coupler 560 further assists in the reciprocating motion of the valve assembly 200 when the valve 200 returns to the first or open position (see e.g., FIG. 19) with a zero excursion angle θ.

Figure 26:
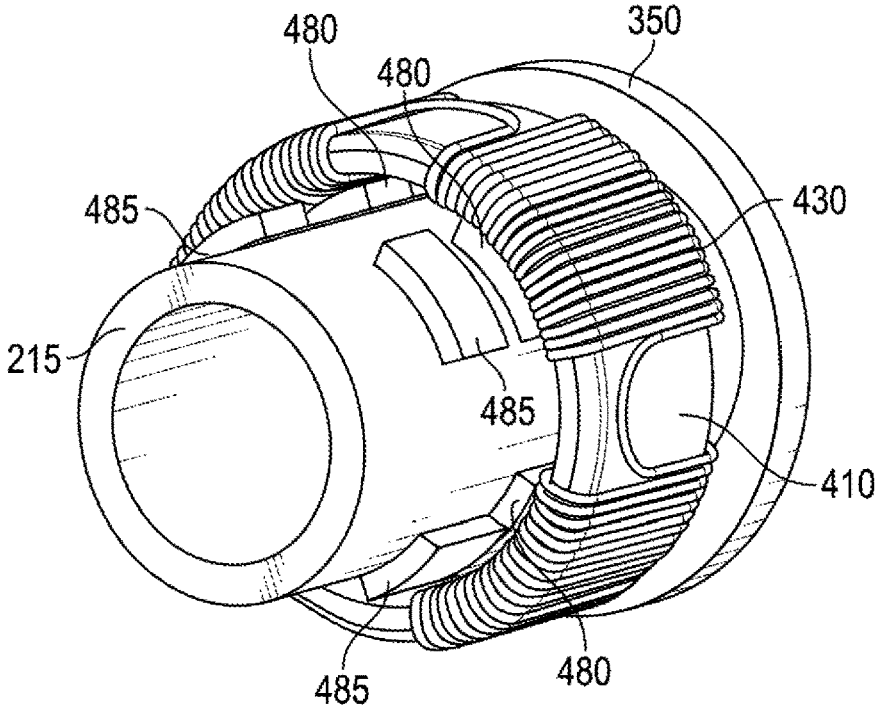
Figure 27:
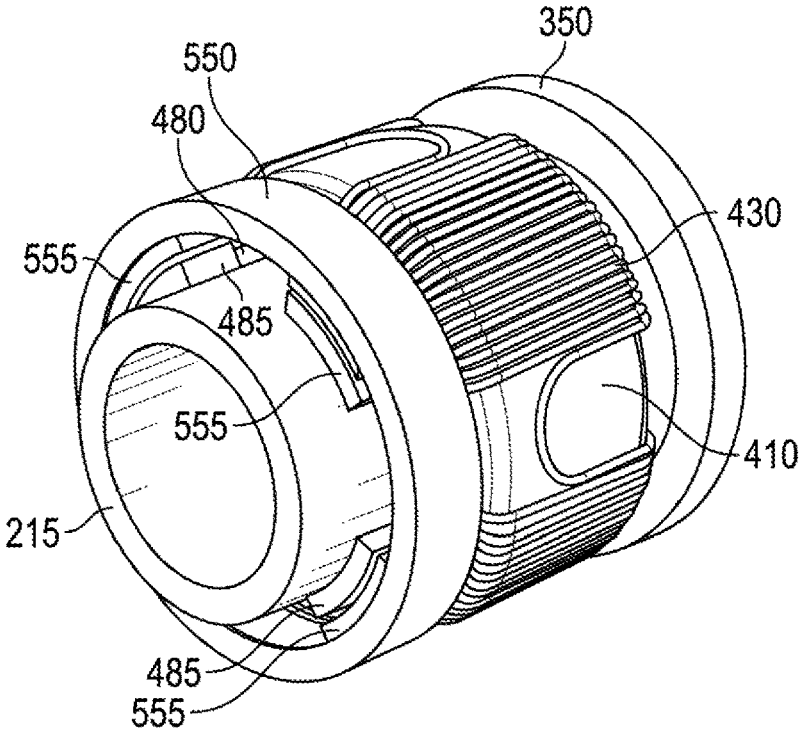

FIGS. 26 and 27 are isometric schematic views of alternative embodiments of the valve assembly 200. In an embodiment, additional magnets 485 may be disposed on rotor main body 215, which may or may not be aligned with the other magnets 480 (FIG. 26). The additional magnets 485 may or may not have the same electrical polarity and may or may not be aligned with the magnets 480 disposed on the rotor main body 215. In an embodiment, a stationary housing 550 comprises an annular ring having magnets 555 with a polarity opposite the polarity of the additional magnets 485 disposed on the rotor main body 215 (FIG. 27), and together form a magnetic coupler 560. When the coupler magnets (housing magnets 555 and additional magnets 485) are aligned, the valve 200 is in the open position (see e.g., FIG. 18).

Figure 28:
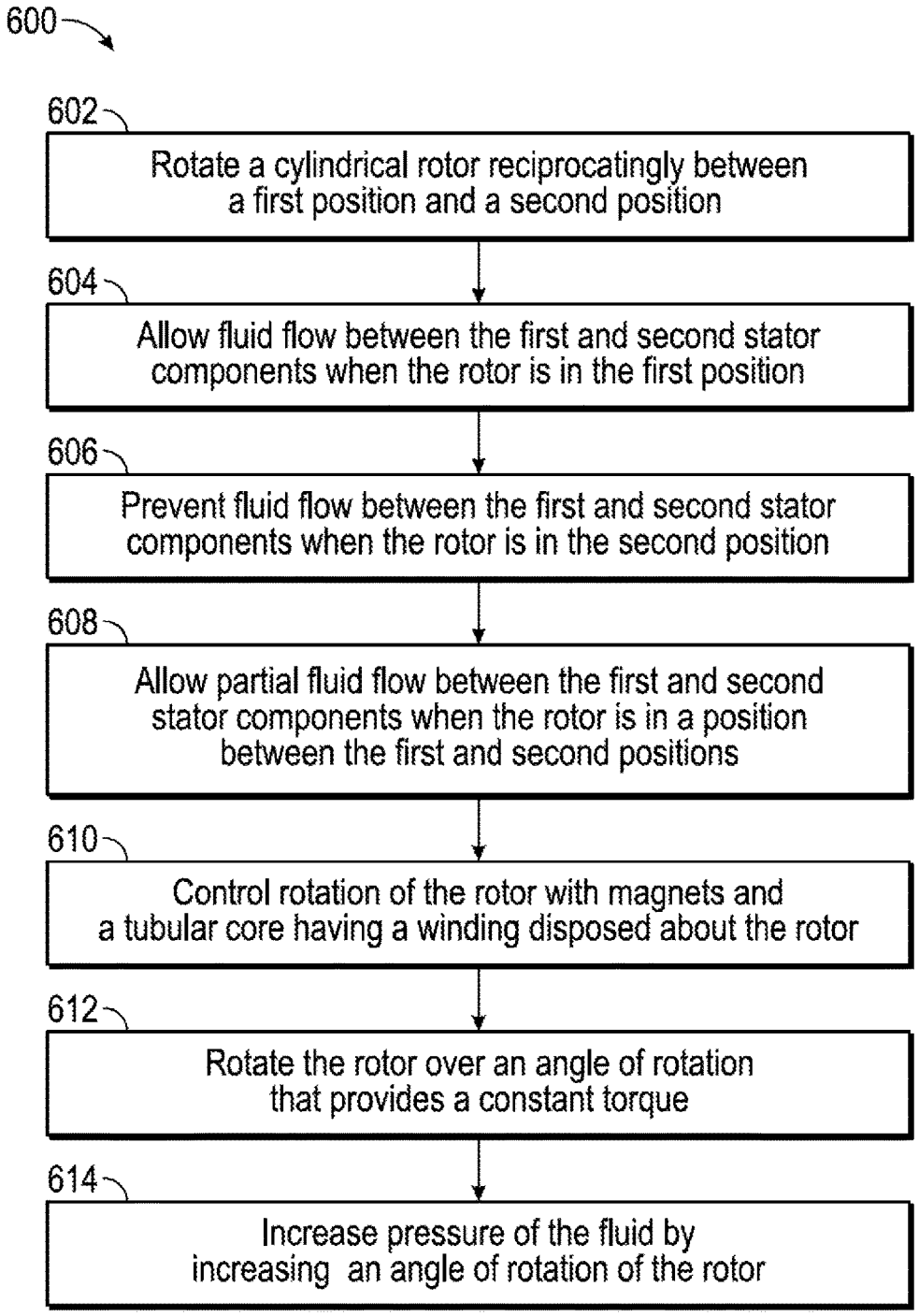
FIG. 28 illustrates embodiments of a method for generating mud pressure waveforms.

In an embodiment and as illustrated in FIG. 28, with continuing reference to FIGS. 1-27, a method 600 of generating mud pressure waveforms is described. The method 600 may be used for any operation where the transfer of information is needed—information may be transmitted in any direction through the pressure waveforms or fluctuations 85.

In a first step 602, the rotor 210 is reciprocatingly rotated between a first or open position (shown in FIG. 19) and a second or closed position (shown in FIG. 20), where the rotor 210 is disposed between the first stator component 310 and an axially-spaced second stator component 350. The cylindrical rotor 210 has a first bore 222*a* spaced axially apart from a second bore 222*b* and a cylindrical blade 230 disposed therebetween. At least a portion of each stator component 310, 350 is disposed in one of the first and second rotor bores 222*a*, 222*b*. The rotor blade 230 also includes a plurality of cutouts 238 that may be sized to align with a plurality of through bores 320, 360 disposed on each stator component 310, 350.

In step 604, fluid flow between the first and second stator components 310, 350 is allowed through the passages or cutouts 238 in the rotor 210 when the rotor 210 is in the first position. In other words, when in the first or open position (FIG. 19), the passages 238 in the rotor 210 are aligned with the through bores 320, 360 in the first and second stator components 310, 350 to allow fluid communication therethrough. Conversely, in step 606, fluid flow between the first and second stator components 310, 350 is prevented by a portion (spokes 242) of the rotor 210 between the passages 238 when the rotor 210 is in the second or closed position (FIG. 20). In step 608, partial fluid flow is allowed between the first and second stator components 310, 350 via a portion of the rotor passages 238 when the rotor 210 is in a position between the first and second positions.

In step 610, the rotation of the rotor 210 is controlled with magnets 480 disposed on the rotor 210 and a tubular core 410 having a winding 430 disposed about the rotor 210. The magnets 480 are spaced equally and radially about a central axis 105 of the rotor 210, and are grouped in pairs 481, 482 with pair members disposed axially across from one another and having matching electric polarities $N_{480a}$, $N_{480c}$, $S_{480b}$, $S_{480d}$. An electrical current is passed through the winding 430 to produce electrical poles $N_1$, $S_1$, $N_2$, $S_2$ that correspond to changes in the direction of the winding 430 wrapped around the core 410 such that adjacent electrical poles have opposite electrical polarity. The core 410, winding 430, magnets 480, and rotor 210 operate like a limited angle torque motor to electromagnetically produce torque by reciprocatingly rotating the rotor within an angle of rotation θ.

In step 612, the rotor 210 is rotated over an angle of rotation θ that provides constant torque τ. In step 614, the pressure of the fluid 54 is increased by increasing the angle of rotation θ of the rotor 210.

Thus, an actuator system for communicating with a telemetry tool has been described. Embodiments of the actuator system may generally include a cylindrical rotor having a first bore spaced axially apart from a second bore and at least one passageway therebetween; a stator having a first and second component, each stator component including at least one through bore with at least a portion of each stator component disposed in one of the first and second rotor bores; and an actuator having a tubular core wrapped with a winding and a plurality of magnets, the core disposed about the rotor; wherein at least one magnet is disposed on an outer cylindrical surface of the rotor. Other embodiments of the actuator system may generally include a cylindrical rotor having a first bore spaced axially apart from a second bore and a cylindrical blade disposed therebetween, the blade having a plurality of cutouts; a stator having a first and second component, each stator component including a plurality of through bores with at least a portion of each stator component disposed in one of the first and second rotor bores; and an actuator having a tubular core wrapped with a winding disposed about the rotor, and a plurality of magnets disposed on an outer cylindrical surface of the rotor.

For any of the foregoing embodiments, an actuator system may include any one of the following elements, alone or in combination with each other. The magnets are spaced equally and radially about a central axis of the rotor. The magnets are grouped in pairs with pair members disposed axially across from one another and having matching electric polarities. The electric polarity of each magnet is opposite the electric polarity of each adjacent magnet. The core has electrical poles, with adjacent electrical poles having opposite electrical polarity and corresponding to locations on the core where the orientation of the winding changes from a first direction to a second direction opposite the first direction. The core is disposed around the magnets and the rotor. At least one passageway of the rotor and the at least one through bore of the first and second stator components are aligned when the magnets are disposed halfway between electrical poles of the core. The magnets extend beyond a width of the core. A magnetic coupler including an additional annular ring is disposed around the rotor and adjacent the coil and winding. The additional housing includes stationary magnets aligned with a portion of the magnets on the rotor extending beyond the width of the core and having electrical polarities opposite the electrical polarities of the magnets disposed on the rotor. Additional magnets are disposed on the rotor beyond a width of the core. A magnetic coupler including an additional annular ring is disposed around the rotor and adjacent the coil and winding. The additional housing further includes stationary magnets. The plurality of through bores of the first and second stator components are aligned and positioned to match the plurality of cutouts of the rotor. The cutouts in the rotor blade and the through bores in the first and second stator components are aligned and in fluid communication when the rotor is in a first position. The rotor blade blocks fluid communication between the first and second stator components when the rotor is in a second position. The magnets are spaced equally and radially about a central axis of the rotor. The magnets are grouped in pairs with pair members disposed axially across from one another and having matching electric polarities. The electric polarity of each magnet is opposite the electric polarity of each adjacent magnet. The core has electrical poles, with adjacent electrical poles having opposite electrical polarity and corresponding to locations on the core where the orientation of the winding changes from a first direction to a second direction opposite the first direction.

Thus, a method for generating mud pressure waveforms has been disclosed. Embodiments of the method include rotating a cylindrical rotor reciprocatingly between a first position and a second position, the rotor disposed between a first stator component and an axially-spaced second stator component; allowing fluid flow between the first and second stator components via passages in the rotor when the rotor is in the first position; preventing fluid flow between the first and second stator components with portion of the rotor between the passages when the rotor is in the second position; allowing partial fluid flow between the first and second stator components via a portion of the rotor passages when the rotor is in a position between the first and second positions; controlling the rotation of the rotor with magnets disposed on the rotor and a tubular core having a winding disposed about the rotor.

For any of the foregoing embodiments, the method may include any one of the following steps, alone or in combination with each other. Passing an electrical current through the winding. Producing electrical poles corresponding to a direction of the winding on the core. Rotating the rotor over an angle of rotation that provides a constant torque. Increasing pressure of the fluid by increasing the angle of rotation of the rotor.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. An actuator system for communicating with a telemetry tool, the actuator system comprising:

a rotor having a first bore spaced axially apart from a second bore by a solid portion and at least one passageway therebetween;

a stator having a first and second component, each stator component including at least one through bore with a portion of each stator component disposed in a respective one of the first and second rotor bores; and an actuator having a tubular core wrapped with a winding and a plurality of magnets, the core disposed about the rotor;

wherein at least one of the magnets is disposed on an outer surface of the rotor.

2. The actuator system of claim 1, wherein the magnets are spaced equally and radially about a central axis of the rotor, and are grouped in pairs with pair members disposed axially across from one another and having matching electric polarities.

3. The actuator system of claim 2, wherein the electric polarity of each magnet is opposite the electric polarity of each adjacent magnet.

4. The actuator system of claim 3, wherein the core has electrical poles, with adjacent electrical poles having opposite electrical polarity and corresponding to locations on the core where the orientation of the winding changes from a first direction to a second direction opposite the first direction.

5. The system of claim 4, wherein the core is disposed around the magnets and the rotor.

6. The system of claim 5, wherein the at least one passageway of the rotor and the at least one through bore of the first and second stator components are aligned when the magnets are disposed halfway between electrical poles of the core.

7. The system of claim 5, wherein the magnets extend beyond a width of the core.

8. The system of claim 7, further comprising a magnetic coupler including an additional annular ring disposed around the rotor and adjacent the coil and winding;

wherein the additional housing further includes stationary magnets aligned with a portion of the magnets on the rotor extending beyond the width of the core and having electrical polarities opposite the electrical polarities of the magnets disposed on the rotor.

9. The system of claim 5, wherein additional magnets are disposed on the rotor beyond a width of the core.

10. The system of claim 9, further comprising a magnetic coupler including an additional annular ring disposed around the rotor and adjacent the coil and winding;

wherein the additional housing further includes stationary magnets.

11. An actuator system for communicating with a telemetry tool, the actuator system comprising:

a rotor having a first bore spaced axially apart from a second bore and a blade disposed therebetween, the blade having a plurality of cutouts;

a stator having a first and second component, each stator component including a plurality of through bores with a portion of each stator component disposed in a respective one of the first and second rotor bores; and an actuator having a tubular core wrapped with a winding disposed about the rotor, and a plurality of magnets disposed on an outer surface of the rotor.

12. The system of claim 11, wherein the plurality of through bores of the first and second stator components are aligned and positioned to match the plurality of cutouts of the rotor.

13. The system of claim 12, wherein the cutouts in the rotor blade and the through bores in the first and second stator components are aligned and in fluid communication when the rotor is in a first position.

14. The system of claim 13, wherein the rotor blade blocks fluid communication between the first and second stator components when the rotor is in a second position.

15. The system of claim 14, wherein the magnets are spaced equally and radially about a central axis of the rotor, and are grouped in pairs with pair members disposed axially across from one another and having matching electric polarities; and wherein the electric polarity of each magnet is opposite the electric polarity of each adjacent magnet.

16. The actuator system of claim 15, wherein the core has electrical poles, with adjacent electrical poles having opposite electrical polarity and corresponding to locations on the core where the orientation of the winding changes from a first direction to a second direction opposite the first direction.

17. A method for generating mud pressure waveforms, the method comprising:

rotating a rotor reciprocatingly between a first position and a second position, the rotor disposed between a first stator component and an axially-spaced second stator component;

allowing fluid flow between the first and second stator components via passages in the rotor when the rotor is in the first position;

preventing fluid flow between the first and second stator components with portion of the rotor between the passages when the rotor is in the second position;

allowing partial fluid flow between the first and second stator components via a portion of the rotor passages when the rotor is in a position between the first and second positions;

controlling the rotation of the rotor with magnets disposed on the rotor and a tubular core having a winding disposed about the rotor.

18. The method of claim 17, wherein controlling the rotation of the rotor further comprises:

passing an electrical current through the winding; and producing electrical poles corresponding to a direction of the winding on the core.

19. The method of claim 18, further comprising rotating the rotor over an angle of rotation that provides a constant torque.

20. The method of claim 19, further comprising increasing pressure of the fluid by increasing the angle of rotation of the rotor.

* * * * *